US007832171B2

(12) United States Patent
Erickson et al.

(10) Patent No.: US 7,832,171 B2
(45) Date of Patent: Nov. 16, 2010

(54) CONSTRUCTION FRAMING SYSTEM AND TRACK THEREFOR

(76) Inventors: Dennis Erickson, Suite 301 - 7377 Salisbury Avenue, Burnaby, BC (CA) V5E 4B2; Keith Taylor, 1410 Toronto Place, Port Coquitlam, BC (CA) V3B 2T7

( * ) Notice: Subject to any disclaimer, the term of this patent is extended or adjusted under 35 U.S.C. 154(b) by 1122 days.

(21) Appl. No.: 10/733,321

(22) Filed: Dec. 12, 2003

(65) Prior Publication Data

US 2005/0126104 A1 Jun. 16, 2005

(51) Int. Cl.
*E04C 3/02* (2006.01)

(52) U.S. Cl. ..... 52/653.1; 52/93.1; 52/843; 52/844; 52/845

(58) Field of Classification Search ..... 52/241, 52/242, 290, 481.1, 481.2, 238.1, 729, 732, 52/93.1, 639, 653.1, 653.2, 691, 745.21, 52/838–840, 842–845, 836, 848
See application file for complete search history.

(56) References Cited

U.S. PATENT DOCUMENTS

| | | | | |
|---|---|---|---|---|
| 3,333,390 | A | 8/1967 | Banning | |
| 3,999,875 | A * | 12/1976 | Simon | 403/186 |
| 4,397,127 | A | 8/1983 | Mieyal | |
| 4,443,991 | A | 4/1984 | Mieyal | |
| 4,809,476 | A * | 3/1989 | Satchell | 52/241 |
| 4,918,899 | A * | 4/1990 | Karytinos | 52/690 |
| 5,040,345 | A * | 8/1991 | Gilmour | 52/243.1 |
| 5,127,203 | A | 7/1992 | Paquette | |
| 5,127,760 | A | 7/1992 | Brady | |
| 5,313,752 | A | 5/1994 | Hatzinikolas | |
| 5,685,121 | A | 11/1997 | DeFrancesco et al. | |
| 5,755,066 | A | 5/1998 | Becker | |
| 5,906,080 | A | 5/1999 | DiGirolamo et al. | |
| 5,913,788 | A | 6/1999 | Herren | |
| 6,088,982 | A | 7/2000 | Hiesberger | |
| 6,115,984 | A * | 9/2000 | Paradis | 52/717.03 |
| 6,176,053 | B1 | 1/2001 | St. Germain | |
| 6,199,341 | B1 * | 3/2001 | Carlin et al. | 52/653.1 |
| 6,237,301 | B1 * | 5/2001 | Paradis | 52/717.03 |
| 6,374,558 | B1 * | 4/2002 | Surowiecki | 52/241 |
| 7,216,465 | B2 * | 5/2007 | Saldana | 52/655.1 |

(Continued)

FOREIGN PATENT DOCUMENTS

JP 2000336899 12/2000

OTHER PUBLICATIONS

Excerpt from Steeler, Inc. Drywall Construction Supply Catalogue, Steeler, Inc., Feb. 14, 1994, p. 56.

(Continued)

*Primary Examiner*—Jeanette E. Chapman
(74) *Attorney, Agent, or Firm*—Oyen Wiggs Green & Mutala LLP

(57) ABSTRACT

A framing system for use in a building structure includes a track having a longitudinally-extending web and a pair of spaced apart legs which extend from the web to form a channel between the web and the legs. One or more longitudinally-extending studs are coupleable to the legs of the track. Each leg of the track comprises a deformable portion, the deformation of which is accompanied by movement of the one or more studs toward or away from the web.

42 Claims, 14 Drawing Sheets

U.S. PATENT DOCUMENTS

| | | | | |
|---|---|---|---|---|
| 7,223,043 | B1 * | 5/2007 | Andrews | 403/363 |
| 2003/0074849 | A1 | 4/2003 | Surowiecki | |
| 2003/0196401 | A1 | 10/2003 | Surowiecki | |
| 2004/0003564 | A1 | 1/2004 | Surowiecki | |

OTHER PUBLICATIONS

Excerpt from Steeler, Inc. Drywall Construction Supply Catalogue, Steeler, Inc., Copyright 2003, Mar. 14, 2003.

* cited by examiner

CONSTRUCTION FRAMING SYSTEM AND TRACK THEREFOR

TECHNICAL FIELD

The invention relates to the field of construction. Particular embodiments of the invention relate to framing systems for use in construction of buildings and other structures.

BACKGROUND

Framing systems having components made of metal, typically steel or other alloys, referred to as "steel stud" framing systems, are currently used in many industrial and commercial buildings and in an increasing number of residential buildings. Steel stud framing systems have several advantages over conventional wooden framing systems including reduced environmental concerns, fire safety and freedom from warpage, insect damage and rot. Typical steel stud framing systems incorporate horizontal tracks and vertical studs which support interior and/or exterior wall coverings. Typical wall coverings include drywall panels, stucco panels and the like. These wall coverings are usually secured to the studs of the framing system by suitable fasteners. Typically, wall coverings and their joints are taped or otherwise finished to conceal the fasteners and/or the joints.

In older framing systems, vertical studs are rigidly connected to horizontal joists, beams or tracks which are affixed to (or are part of) the building structure that defines the floor (s), ceiling(s) and/or roof. The rigid connections of such framing systems do not allow relative movement between the framing system components. This rigidity presents a serious problem in some circumstances. For example, rigid framing systems can be damaged if there is any relative movement of the building structure components between which the framing systems are mounted. Relative movement of the building structure components typically occurs because of varying load conditions on the floor(s) or the roof of a building. Load conditions which vary over the life of a building structure may typically be referred to by engineers as "live loads". Examples of live loads include, without limitation, introduction or removal of heavy loads on the floor(s) or the roof, snow on the building roof, seismic activity, and heat-related expansion and/or contraction. Under varying load conditions, pressure and forces can weaken and damage the framing system and/or the building structure and can cause cracks in the wall coverings, which are unsightly, unsafe and which may lead to further damage to the framing system and/or the building structure.

Accordingly, there is a general desire to provide framing systems for building structures which accommodate movement of the framing system components relative to one another and/or relative to the building structure to alleviate pressure caused by varying load conditions.

There are a number of patents related to framing systems for building structures. Such patents include:

U.S. Pat. No. 3,333,390 (Banning);
U.S. Pat. No. 4,397,127 (Mieyal);
U.S. Pat. No. 4,443,991 (Mieyal);
U.S. Pat. No. 5,040,345 (Gilmour);
U.S. Pat. No. 5,127,203 (Paquette);
U.S. Pat. No. 5,127,760 (Brady);
U.S. Pat. No. 5,313,752 (Hatzinikolas);
U.S. Pat. No. 5,685,121 (DeFrancesco et al.);
U.S. Pat. No. 5,755,066 (Becker);
U.S. Pat. No. 5,906,080 (diGirolamo et al.);
U.S. Pat. No. 5,913,788 (Herren);

U.S. Pat. No. 6,088,982 (Hiesberger);
U.S. Pat. No. 6,176,053 (St. Germain); and,
U.S. Pat. No. 6,374,558 (Surowiecki).

The framing systems disclosed in these patents have a number of disadvantages, which include, for example: requiring additional "slip tracks" positioned between the vertical studs and the horizontal tracks; requiring clip components and/or stud extension members located and/or connected between the horizontal tracks and the vertical studs; requiring complex-shaped, difficult to fabricate studs or tracks; and requiring slotted tracks penetrated by fasteners or other projections. Some of these framing systems require relatively costly components and relatively large amount of installation time. In addition, some of these prior art systems permit an undesirably small amount of movement of the studs relative to the tracks.

There is a general need in the construction industry for framing systems which accommodate movement of the framing system components relative to one another and/or their associated building structures and which ameliorate at least some of the aforementioned and/or other disadvantages of prior art framing systems.

SUMMARY OF THE INVENTION

A first aspect of the invention provides a track for use in a building framing system. The track comprises a web that extends in a longitudinal direction and one or more deformable legs. The one or more deformable legs extend from the web and extend along at least a portion of the web in the longitudinal direction. Each deformable leg includes a deformable portion located between the web and its distal edge. Deformation of the deformable portion of each leg is accompanied by relative movement of the distal edge of the leg in a direction that is toward the web and/or away from the web.

A section of each deformable leg that includes the deformable portion may consist essentially of a unitary piece of material.

The deformable portion of each leg may comprise at least one deformable groove that extends in the longitudinal direction. The deformable groove may be resiliently deformable. The deformable groove may be compressible in a direction orthogonal to the longitudinal direction and/or expandable in a direction orthogonal to the longitudinal direction. The deformable groove may comprise a first angled groove portion that extends from a bend in an upper portion of the leg, a second angled groove portion that extends from a bend in a lower portion of the leg and a central groove portion that extends between bends in the first and second angled groove portions. Alternatively, the deformable groove may comprise a first angled groove portion that extends from a bend in an upper portion of the leg and second angled groove portion that extends from a bend in a lower portion of the leg, and the first and second angled groove portions may extend to meet one another at a groove bend.

Each leg may comprise a flat portion between its deformable groove and its distal edge. The flat portion may provide a surface to which one or more studs may be coupled.

The one or more legs may comprise a pair of spaced apart legs which extend from the web to define a channel therebetween. The deformable groove(s) may project into or outwardly from the channel or both. The deformable groove(s) may comprise at least one edge portion that is arcuate in cross-section.

The deformable portion of each leg may comprise a plurality of deformable grooves, each of which may extend in the longitudinal direction and each of which may be compressible in a direction orthogonal to the longitudinal direction and/or expandable in a direction orthogonal to the longitudinal direction.

The deformable portion of each leg may comprise at least one bend which may extend in the longitudinal direction and which may be compressible to reduce its interior angle and/or expandable to increase its interior angle.

The deformable portion of each leg may comprise a curved bend of the leg, which has an interior angle greater than 90° and which curves toward an interior of the channel.

The track may consist essentially of a unitary piece of material.

The track may be used in a wall of a building, wherein the wall also comprises an opposing track and one or more studs. The studs may extend between the track and the opposing track and may be coupled at their opposite ends to the track and to the opposing track. A first portion of each stud may be coupled to the one or more legs of the track between the deformable portions and the distal edges of the one or more legs. Relative movement of the stud toward the web may cause compression of the deformable portion of each leg. Relative movement of the stud away from the web may cause expansion of the deformable portion of each leg.

The one or more legs of the track may comprise a pair of spaced apart legs which extend from the web to define a channel therebetween. Each leg of the track may comprise a flat portion located between its deformable portion and its distal edge. A first end portion of each stud may extend into the channel and may be coupled to the flat portion of each leg. The channel may be a downwardly or upwardly opening channel.

An opposing end portion of each stud may be coupled to the opposing track in a manner that does not permit substantial relative movement between the stud and the opposing track. Alternatively, the opposing track may be substantially similar to the track and an opposing end of each stud may be coupled to the opposing track in a manner that permits relative movement between the stud and the opposing track.

The deformable portion of each leg may comprise an elastic member. Each elastic member may be fabricated separately from the track and subsequently coupled to the corresponding leg of the track.

Each deformable leg may consist essentially of a unitary piece of material.

A section of each deformable leg that includes the deformable portion may comprise a sheet of material having at least one bend which extends in the longitudinal direction and which is compressible to reduce its interior angle and/or expandable to increase its interior angle.

Another aspect of the invention provides a track for use in a building framing system. The track comprises an elongated member that extends in a longitudinal direction and a pair of legs. The legs extend from the elongated member at spaced apart locations and along at least a portion of the elongated member in the longitudinal direction to define a channel therebetween. At least one of the legs has a deformable portion located between its distal edge and the elongated member.

The deformable portion may extend in the longitudinal direction and may be compressible to reduce a dimension of the deformable portion in a direction orthogonal to the longitudinal direction and/or expandable to increase the dimension of the deformable portion in a direction orthogonal to the longitudinal direction. A section of the at least one leg that includes the deformable portion may comprise a unitary sheet of material and the deformable portion may comprise at least one bend in the sheet of material.

Another aspect of the invention provides a track for use in a building framing system. The track comprises a longitudinally-extending web, one or more legs which extend from the web and means for permitting deformation of the one or more legs. Deformation of the one or more legs accommodates relative movement between distal edges of the one or more legs and the web in a direction substantially orthogonal to a plane of the web.

Yet another aspect of the invention provides a method for accommodating relative movement between a track and one or more studs in a building framing system. The method involves a track having a web which extends in a longitudinal direction and one or more legs which extend from the web and which extend along at least a portion of the web in the longitudinal direction. The method comprises rigidly coupling first ends of the one or more studs to the one or more legs and deforming the one or more legs to permit relative movement of the one or more studs toward the web and/or away from the web.

Deforming the one or more legs may comprise resiliently deforming the one or more legs. Each leg of the track may comprise a deformable groove. Deforming the one or more legs may comprise compressing the deformable groove and/or expanding the deformable groove.

Further features and applications of specific embodiments of the invention are described below.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of this invention relate to framing systems for use in construction of buildings and other structures and to tracks for use in such framing systems. Such framing systems may support interior and/or exterior wall coverings. Framing systems according to the invention are designed to accommodate relative movement between components of the building structure. More specifically, tracks are provided with one or more deformable legs, such that relative movement between building structure components may be accommodated by expansion or compression of the leg(s). Expansion or compression of the leg(s) permits corresponding relative movement between studs attached to the leg(s) and one or more components of the building structure. Tracks in accordance with the invention may be rigidly coupled to floor, ceiling or roof components of the building structure. In preferred embodiments of the invention, tracks are "channel-shaped" with an elongated, horizontally oriented web and a pair of spaced apart legs which project from the web in a generally vertical direction to form a channel that opens upwardly or downwardly. At least one of the legs is vertically deformable. Preferably, the deformable leg(s) are resiliently deformable.

The framing system of preferred embodiments also comprises a plurality of studs, which provide vertical structural support. Each stud may comprise an elongated, vertically oriented web, a pair of side members which project from the web and an optional flange extending from each side member. At least one end of each stud is coupled to a corresponding track. Preferably, the studs and track are shaped such that the studs extend into the upwardly (or downwardly) opening channel of the track with at least one of the side members of the stud coupled to at least one of the deformable legs of the track. Relative movement between building structure components causes deformation of the leg(s) of the track and corresponding relative movement of the studs toward or away from the web of the track and toward or away from the building structure component to which the track is mounted. Deformation of the leg(s) of the track and relative movement of the studs may occur without damage to the track, the studs or the wall covering which may be mounted to the studs.

Figure 1:
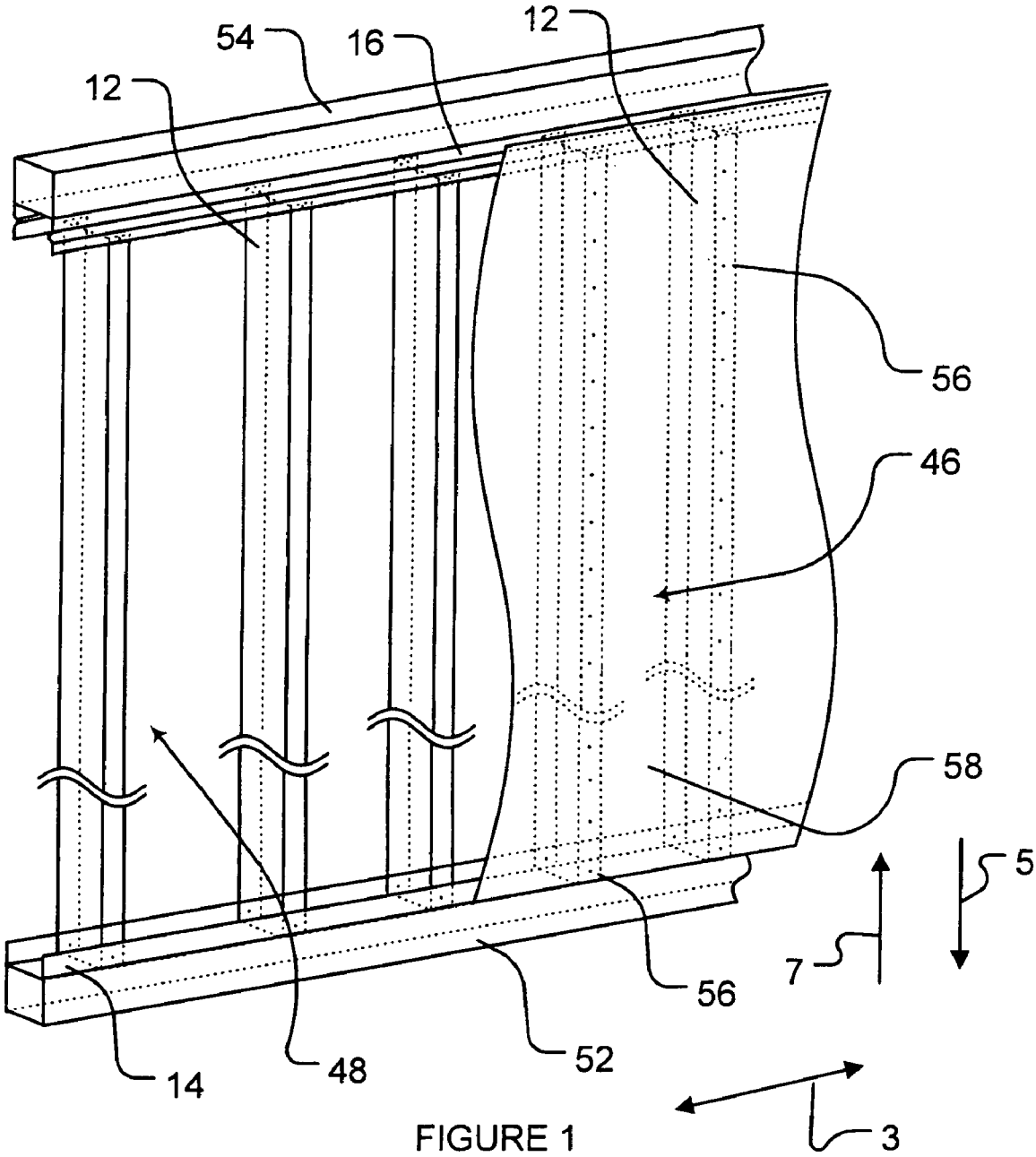
FIG. 1 is a partially cut-away isometric view of a wall incorporating a framing system according to a particular embodiment of the invention.

FIG. 1 shows an example of a wall 46 which incorporates a framing system 48 according to a particular embodiment of the invention. In the illustrated embodiment, wall 46 is situated between upper building structure component 54 and lower building structure component 52. Upper building structure component 54 may be a part of the floor above wall 46, a part of a ceiling above wall 46 or a part of the building structure associated with the roof of the building, for example. Similarly, lower building structure component 52 may be a part of the floor below wall 46 or a part of the foundation of the building, for example.

This description incorporates a number of directional conventions to clarify its meaning:

(i) "upper", "upward", "upwardly", "upwardmost" and similar words refer to a direction extending toward upper building structure component 54 as indicated by arrow 7;

(ii) "lower", "lowermost", "downward", "downwardly", "downwardmost" and similar words refer to a direction extending toward lower building structure component 52 as indicated by arrow 5;

(iii) "vertical", "vertically" and similar words refer to either of the upward or downward directions; and, (iv) "horizontal", "horizontally" and similar words refer to any direction transverse to the upward and downward directions as indicated, for example, by double headed arrow 3.

The above-noted words are defined herein for ease of explanation only. Those skilled in the art will appreciate that the framing system components, parts of framing system components and framing systems that form part of this invention need not be oriented strictly vertically and/or horizontally and that the directional words used in this description should not be interpreted narrowly.

In the illustrated embodiment, framing system 48 comprises a horizontally-extending, channel-shaped lower track 14 and a corresponding horizontally-extending, channel-shaped upper track 16. Lower track 14 comprises a channel which opens upwardly and upper track 16 comprises a channel that opens downwardly. Framing system 48 also comprises a plurality of studs 12 which extend between lower track 14 and upper track 16.

The phrase "building structure" is used herein to refer to the infrastructure of a building. A building structure may comprise the frame, the roof and/or the foundation of a building and is typically, but not necessarily, made from wood, concrete, iron and/or structural steel. Upper building structure component 54 and lower building structure component 52 represent examples of building structure components. A building structure may comprise components which deform or otherwise move relative to one another under varying load conditions. Upper track 16 and lower track 14 of framing system 48 may be rigidly coupled to the components of the building structure.

Figure 2:
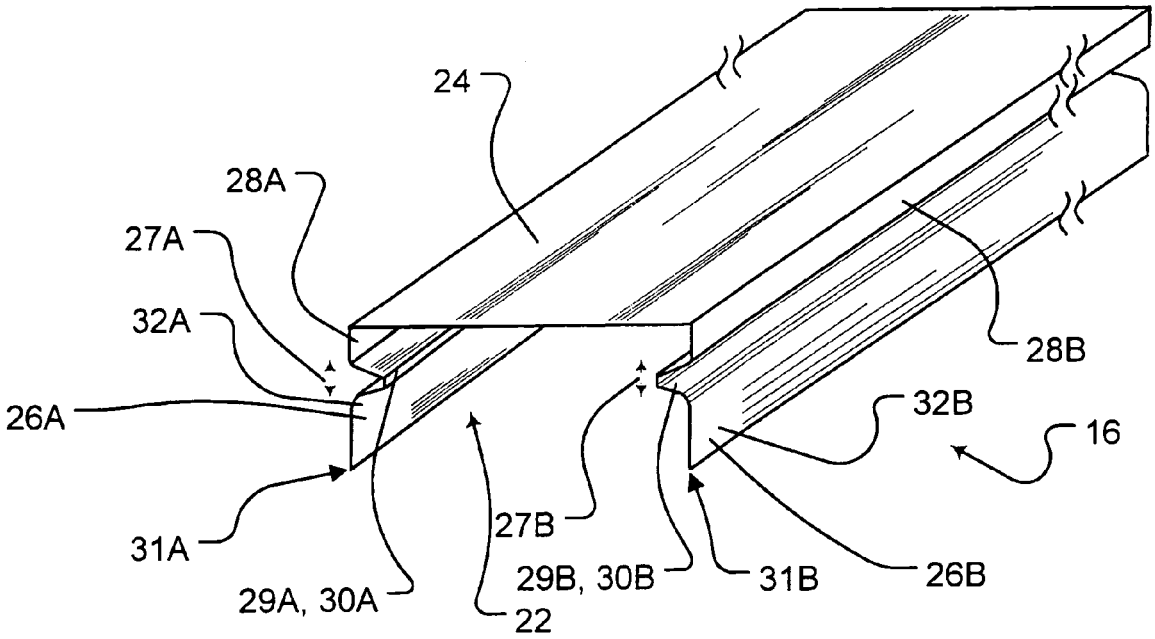
FIG. 2 is an isometric view of the upper track of the FIG. 1 framing system.

FIG. 2 shows an upper track 16 according to a particular embodiment of the invention. In the illustrated embodiment, upper track 16 comprises a generally horizontally oriented web 24 that extends in a longitudinal direction and a pair of legs 26A, 26B, which extend generally downwardly from web 24 at spaced apart locations to form downwardly opening channel 22. Legs 26A, 26B also extend along at least a portion of the longitudinal dimension of web 24. In the illustrated embodiment, legs 26A, 26B respectively comprise upper portions 28A, 28B, deformable portions 30A, 30B and lower portions 32A, 32B. Upper portions 28A, 28B and lower portions 32A, 32B may be generally vertically oriented. Distal edges 31A, 31B of legs 26A, 26B represent the lowermost extent of legs 26A, 26B. In preferred embodiments, deformable portions 30A, 30B comprise at least one bend which extends in the longitudinal direction and which is compressible to reduce its interior angle and/or expandable to increase its interior angle. As will be explained in more detail below, deformation of deformable portions 30A, 30B causes corresponding movement of lower portions 32A, 32B and distal edges 31A, 31B toward and/or away from web 24. Preferably, but not necessarily, deformable portions 30A, 30B are resiliently deformable, such that when deformed, deformable portions 30A, 30B will tend to restore themselves to their initial (i.e. undeformed) state.

In the illustrated embodiment of FIG. 2, deformable portions 30A, 30B respectively comprise grooves 29A, 29B which extend along the elongated, horizontal dimension of legs 26A, 26B. Legs 26A, 26B, including grooves 29A, 29B, may be formed from a unitary piece of material. In preferred embodiments, track 16 including web 24 and legs 26A, 26B, is formed from a unitary piece of material, which may be an appropriately bent piece of sheet metal for example. In alternative embodiments, legs 26A, 26B may be made of multiple pieces of material that are appropriately coupled to one another. For example, any of web 24, upper portions 28A, 28B, deformable portions 30A, 30B and lower portions 32A, 32B may be separate pieces which are suitably coupled to one another using fasteners or other coupling means. As shown in FIG. 2, grooves 29A, 29B preferably open towards an exterior of channel 22 and project towards an interior of channel 22, such that wall covering 58 (FIG. 1) may be positioned flush to the outside of legs 26A, 26B.

FIGS. 3A-3D are partial cross-sectional views of upper track 16 which schematically depict leg 26B, deformable portion 30B and groove 29B in more detail. In the illustrated embodiment, leg 26B is formed from a unitary piece of material and groove 29B comprises two angled groove portions 81, 83, which extend respectively from leg bend 37 in upper portion 28B and leg bend 41 in lower portion 32B of leg 26B, and central groove portion 85, which is approximately parallel with leg 26B and which extends between interior groove bends 39A, 39B in angled groove portions 81, 83. In FIGS. 3A-3D, leg bends 37, 41 have interior angles $\Theta_2$, $\Theta_3$, while interior groove bends 39A, 39B have interior angles $\Theta_{1A}$, $\Theta_{1B}$. Groove 29B has a vertical dimension 35 and a horizontal dimension 33. The depiction of bends 37, 39A, 39B, 41 and angles $\Theta_2$, $\Theta_{1A}$, $\Theta_{1B}$, $\Theta_3$ in FIGS. 3A-3D is intended to be illustrative in nature. In typical applications, the deformation of bends 37, 39A, 39B, 41 and angles $\Theta_2$, $\Theta_{1A}$, $\Theta_{1B}$, $\Theta_3$ may be different than that shown schematically in FIGS. 3A-3D. For example, the profile of bends 37, 39A, 39B, 41 may not be symmetric or bends 37, 39A, 39B, 41 may be more rounded than the illustrated bends.

Figure 3A:
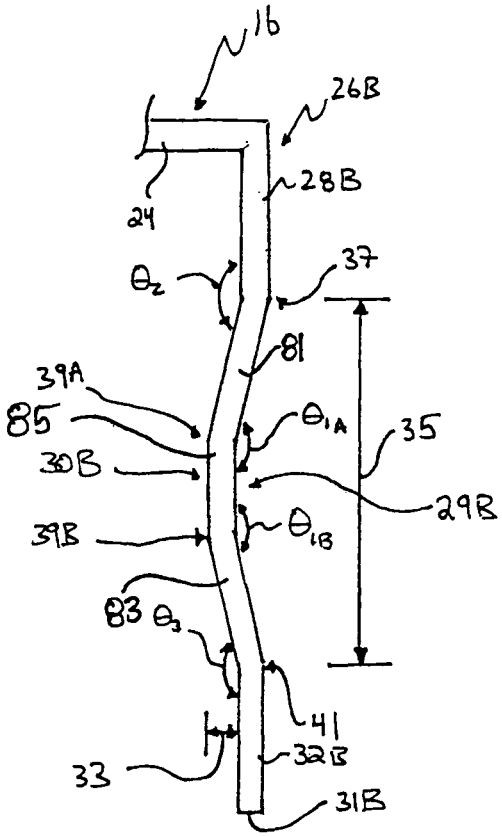
FIGS. 3A-3D are cross-sectional views of a leg of the FIG. 2 track in various states of expansion and compression.
Figure 3B:
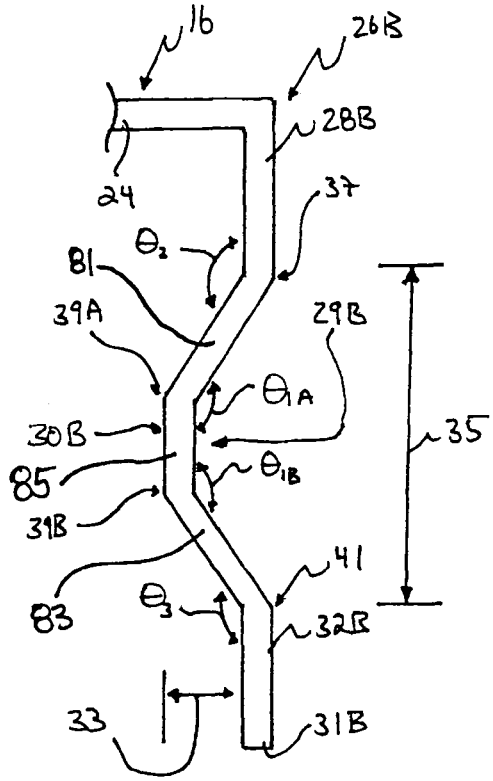
Figure 3C:
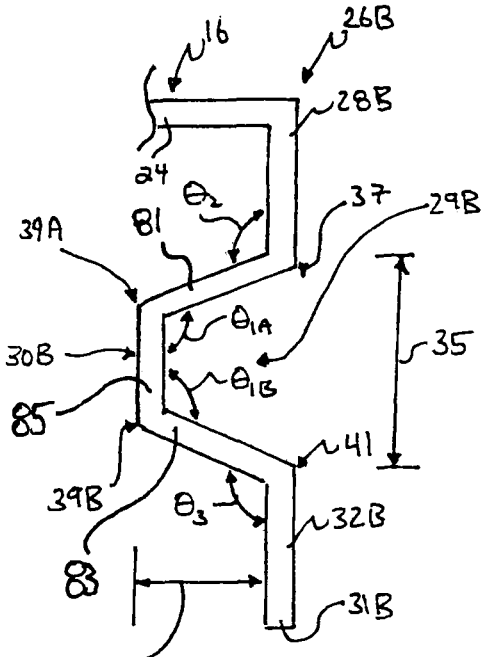
Figure 3D:
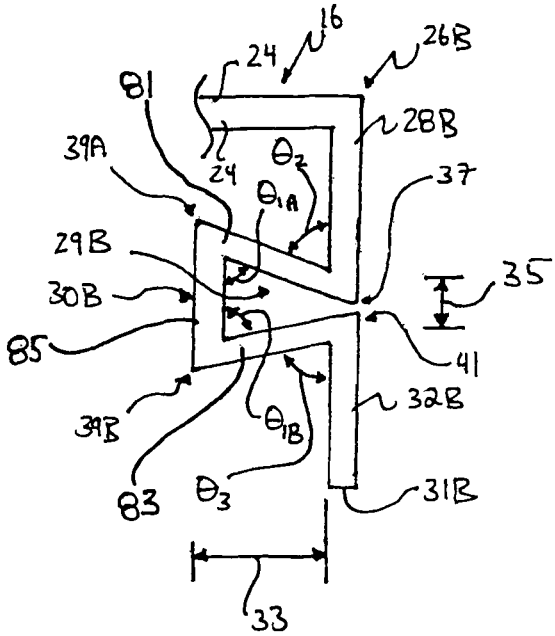

In FIG. 3A, groove 29B is in a significantly expanded state as compared to the relatively compressed states of FIGS. 3B-3D. FIG. 3A represents an expanded state which is near to the maximum expansion of groove 29B. In general, groove 29B may expand until angles $\Theta_{1A}$, $\Theta_{1B}$, $\Theta_2$, $\Theta_3$ are all approximately 180°, angled groove portions 81, 83 are approximately vertical and the horizontal dimension 33 of groove 29B is approximately zero. In FIG. 3B, groove 29B is compressed relative to FIG. 3A, but is still moderately expanded relative to FIGS. 3C and 3D. It can be seen by comparing FIGS. 3A and 3B that angles $\Theta_{1A}$, $\Theta_{1B}$, $\Theta_2$, $\Theta_3$ and vertical dimension 35 decrease as groove 29B is compressed. In FIG. 3C, groove 29B is moderately compressed relative to FIGS. 3A and 3B, but is still expanded relative to FIG. 3D. Again, it can be seen by comparing FIG. 3C to FIGS. 3A and 3B that angles $\Theta_{1A}$, $\Theta_{1B}$, $\Theta_2$, $\Theta_3$ and vertical dimension 35 decrease as groove 29B is compressed. In FIG. 3D, groove 29B is significantly compressed to near its maximum state of compression. In general, groove 29B may be compressed until bends 37 and 41 meet one another. Once again, angles $\Theta_{1A}$, $\Theta_{1B}$, $\Theta_2$, $\Theta_3$ and vertical dimension 35 are smaller in the compressed state of FIG. 3D than in any of the more expanded states of FIGS. 3A-3C.

While FIGS. 3A-3D are schematic in nature, those skilled in the art will appreciate that the initial (i.e. undeformed) state of groove 29B may be somewhere between the moderately expanded state of FIG. 3B and the moderately compressed state of FIG. 3C. In some embodiments, angles $\Theta_{1A}$, $\Theta_{1B}$, $\Theta_2$, $\Theta_3$ may be in a range between 105-165° when groove 29B is in its undeformed state, in a range between 120-180° when groove 29B is expanded and in a range between 60-150° when groove 29B is compressed.

It will be appreciated by comparing FIGS. 3A-3D that when groove 29B is compressed, the contraction of the vertical dimension 35 of groove 29B is accompanied by a corresponding movement of lower portion 32B and distal edge 31B towards web 24. Similarly, when groove 29B is expanded, the extension of the vertical dimension 35 of groove 29B is accompanied by a corresponding movement of lower portion 32B and distal edge 31B away from web 24. Leg 26A of track 16 (not shown in FIGS. 3A-3D) may be substantially similar to leg 26B and may function in a substantially similar manner to leg 26B.

FIGS. 4A-4D are partial cross-sectional views depicting a leg 126B of an upper track 116 in accordance with an alternative embodiment of the invention. In FIGS. 4A-4D, features of track 116 are assigned reference numbers that have a leading "1" relative to similar features of track 16 (FIGS. 2 and 3). In the illustrated embodiment, leg 126B is formed from a single unitary piece of material and comprises a deformable portion 130B having a groove 129B with a different shape than groove 29B of track 16. In the illustrated embodiment, groove 129B comprises two angled groove portions 181, 183, which extend respectively from leg bend 137 in upper portion 128B and leg bend 141 in lower portion 132B of leg 126B. Angled groove portions 181, 183 meet one another at interior groove bend 139. Leg bends 137, 141 have interior angles $\Theta_2$, $\Theta_3$, while interior groove bend 139 has interior angle $\Theta_1$. Groove 129B has a vertical dimension 135 and a horizontal dimension 133. The depiction of bends 137, 139, 141 and angles $\Theta_1$, $\Theta_2$, $\Theta_3$ in FIGS. 4A-4D is intended to be illustrative in nature. In practice, the deformation of bends 137, 139, 141 and angles $\Theta_1$, $\Theta_2$, $\Theta_3$ may be different than that shown schematically in FIGS. 4A-4D.

Figure 4A:
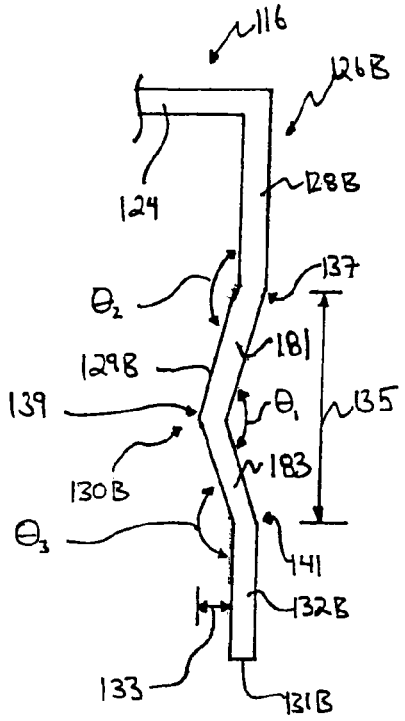
FIGS. 4A-4D are cross-sectional views of a leg of a track according to an alternative embodiment of the invention in various states of expansion and compression.
Figure 4B:
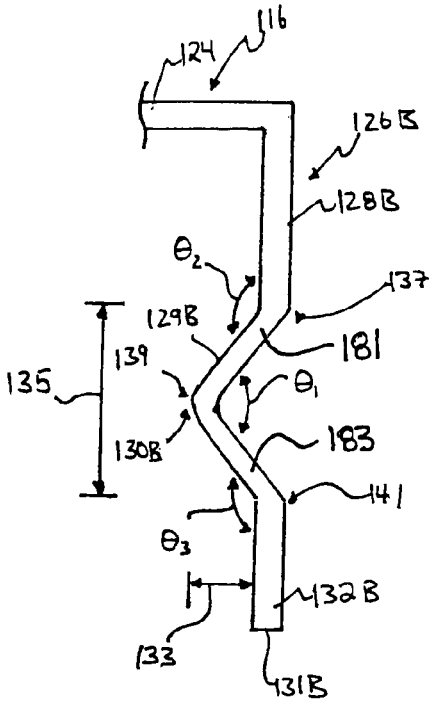
Figure 4C:
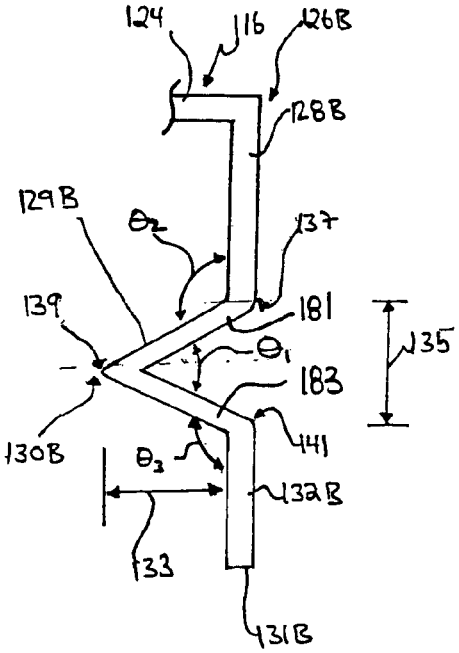
Figure 4D:
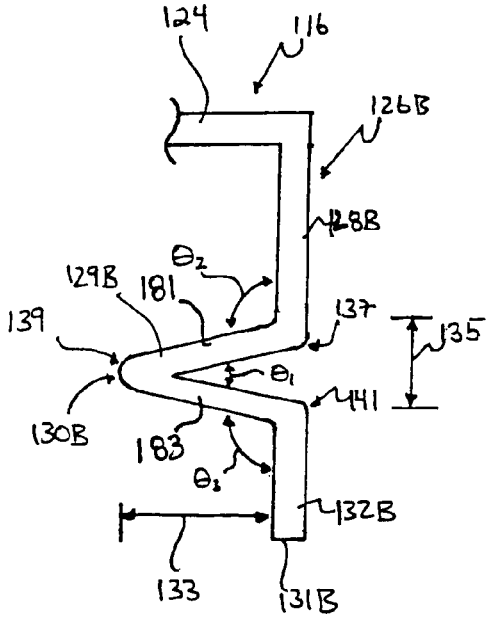

FIGS. 4A-4D represent various states of expansion and contraction of groove 129B, with FIG. 4A being a significantly expanded state, FIG. 4B being a moderately expanded state, FIG. 4C being a moderately compressed state and FIG. 4D being a significantly compressed state. It can be seen by comparing FIGS. 4A-4D that angles $\Theta_1$, $\Theta_2$, $\Theta_3$ and vertical dimension 135 decrease as groove 129B is compressed and angles $\Theta_1$, $\Theta_2$, $\Theta_3$ and vertical dimension 135 increase as groove 129B is expanded. When groove 129B is compressed, the contraction of the vertical dimension 135 of groove 129B is accompanied by a corresponding movement of lower portion 132B and distal edge 131B towards web 124. Similarly, when groove 129B is expanded, the extension of vertical dimension 135 of groove 129B is accompanied by a corresponding movement of lower portion 132B and distal edge 131B away from web 124.

In general, groove 129B may be compressed until bends 137, 141 meet one another and groove 129B may be expanded until angles $\Theta_1$, $\Theta_2$, $\Theta_3$ are all approximately 180° and horizontal dimension 133 is approximately zero. The initial (i.e. undeformed) state of groove 129B may be somewhere between the moderately expanded state of FIG. 4B and the moderately compressed state of FIG. 4C. In some embodiments, angles $\Theta_2$, $\Theta_3$ may be in a range between 105-165° when groove 129B is in its undeformed state, in a range between 120-180° when groove 129B is expanded and in a range between 90-150° when groove 129B is compressed. In such embodiments, interior groove angle $\Theta_1$ will range between 30-150° when groove 129B is in its undeformed state, 60-180° when groove 129B is expanded and 0-120° when groove 129B is compressed. Leg 126A of track 116 (not shown in FIGS. 4A-4B) may be substantially similar to leg 126B and may function in a substantially similar manner to leg 126B.

Figure 5:
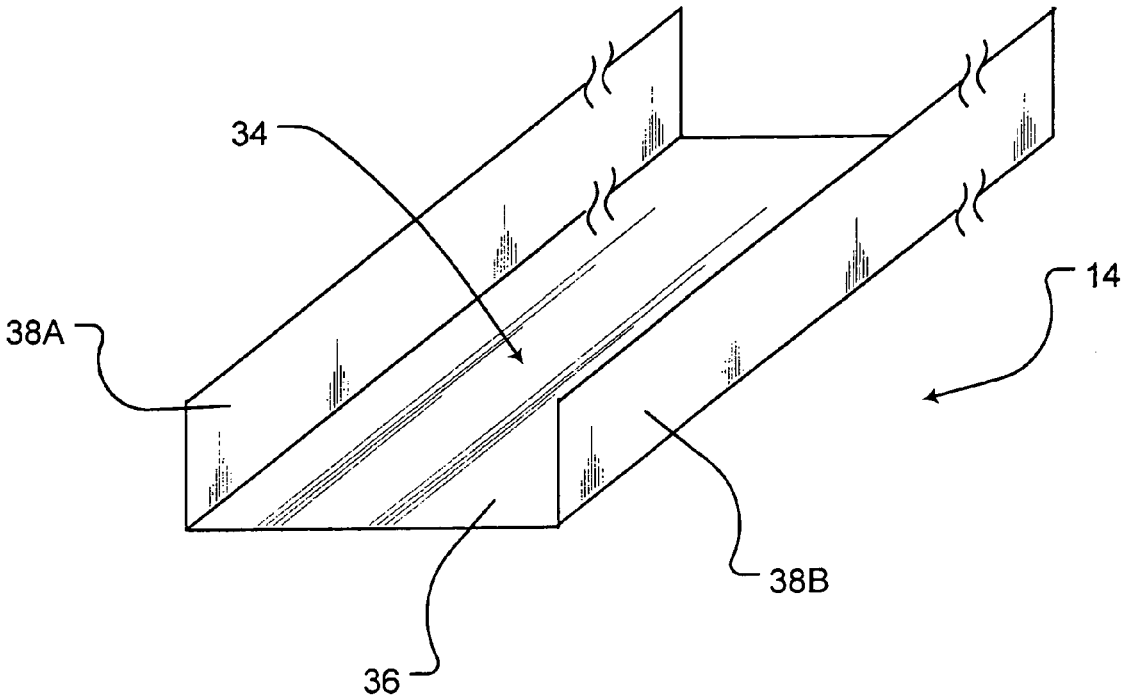
FIG. 5 is an isometric view of the lower track of the FIG. 1 framing system.

FIG. 5 shows a lower track 14 according to a particular embodiment of the invention. In the illustrated embodiment, lower track 14 comprises a generally horizontally-extending web 36 and a pair of spaced apart legs 38A, 38B, which extend generally upwardly from web 36 to form upwardly opening channel 34. In the illustrated embodiment, legs 38A, 38B are flat and are not designed for deformation. In alternative embodiments, legs 38A, 38B of lower tracks 14 may be similar to legs 26A, 26B of upper tracks 16 to provide lower track 14 with the ability to deform as described above.

Figure 6:
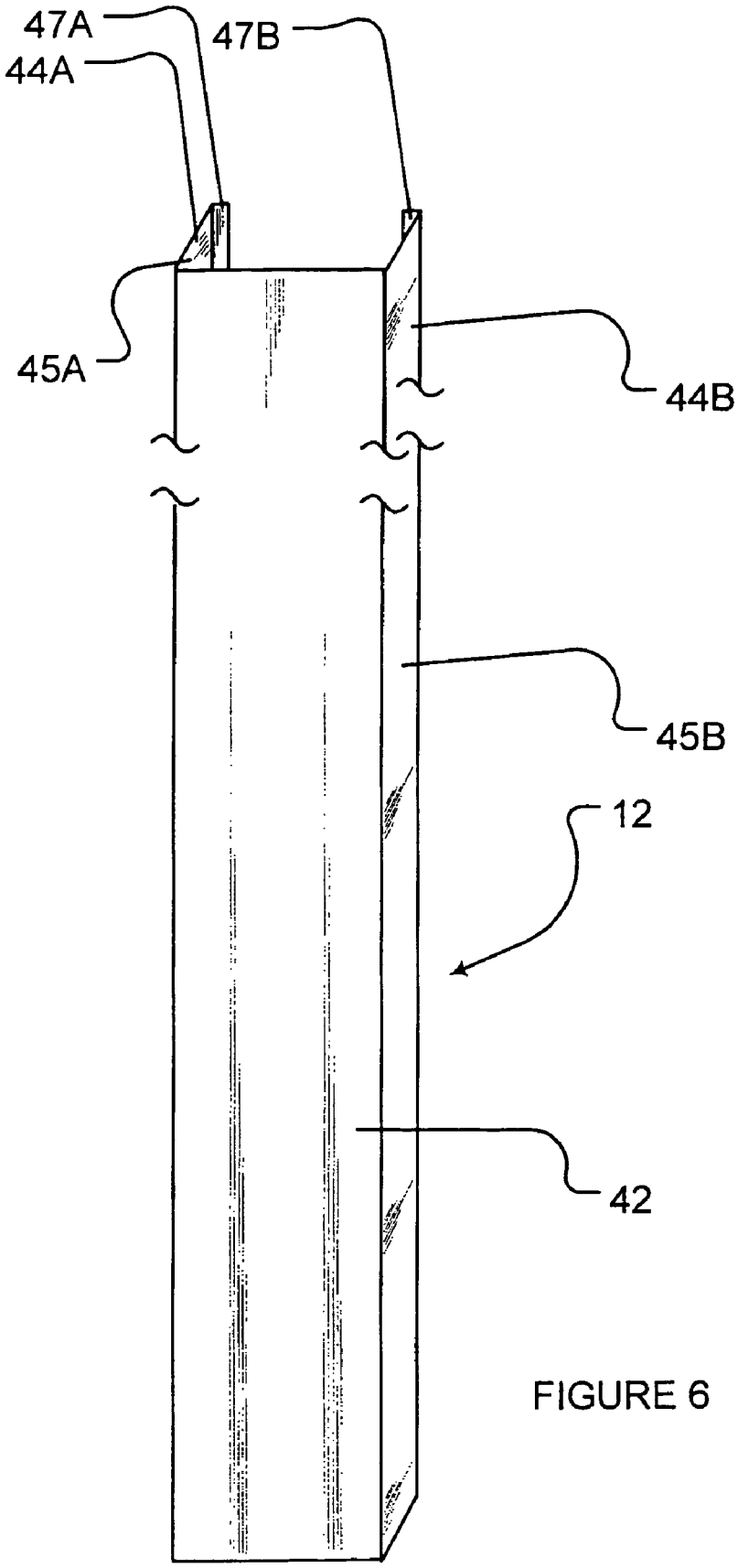
FIG. 6 is an isometric view of a stud of the FIG. 1 framing system.

FIG. 6 shows a stud 12 according to a particular embodiment of the invention. Stud 12 may be substantially similar to the studs currently used and/or known in the construction industry. In the illustrated embodiment, stud 12 is also generally channel-shaped and comprises a vertically-extending web 42 and a pair of spaced-apart side members 44A, 44B which extend from web 42. Side members 44A, 44B provide surfaces for coupling stud 12 to upper track 16 and/or lower track 14 and for mounting wall covering 58 (FIG. 1) to stud 12. In the illustrated embodiment, side members 44A, 44B extend along the entire length of stud 12 to form sidewalls 45A, 45B. In the illustrated embodiment of FIG. 6, stud 12 comprises optional flanges 47A, 47B which project respectively from side members 44A, 44B in directions approximately parallel with the plane of web 42. It should be noted that studs 12 are not shown with optional flanges 47A, 47B in the other drawings of this description to avoid unnecessary complexity.

Tracks 14, 16 and studs 12 are preferably made out of relatively lightweight rolled steel and may be fabricated, for example, by bending appropriately sized pieces of sheet metal. However, tracks 14, 16 and studs 12 may alternatively be made from other suitable materials having sufficient durability, strength and flexibility to function as described herein. Preferably, each track 14, 16 and stud 12 is fabricated from a single piece of material. In general, however, different parts of tracks 14, 16 and studs 12 may be separately fabricated and assembled as required.

Referring to FIG. 1, framing system 48 comprises an upper track 16 of the type shown in FIG. 2, a lower track 14 of the type shown in FIG. 5 and a plurality of studs 12 of the type shown in FIG. 6. In the illustrated wall 46 of FIG. 1, upper track 16 is mounted to building structure component 54 by suitable fastener(s) or any other suitable coupling means (not shown). In the illustrated wall 46 of FIG. 1, lower track 14 is similarly mounted to building structure component 52. The lower ends of studs 12 are coupled to lower track 14 and the upper ends of studs 12 are coupled to upper track 16.

Figure 7:
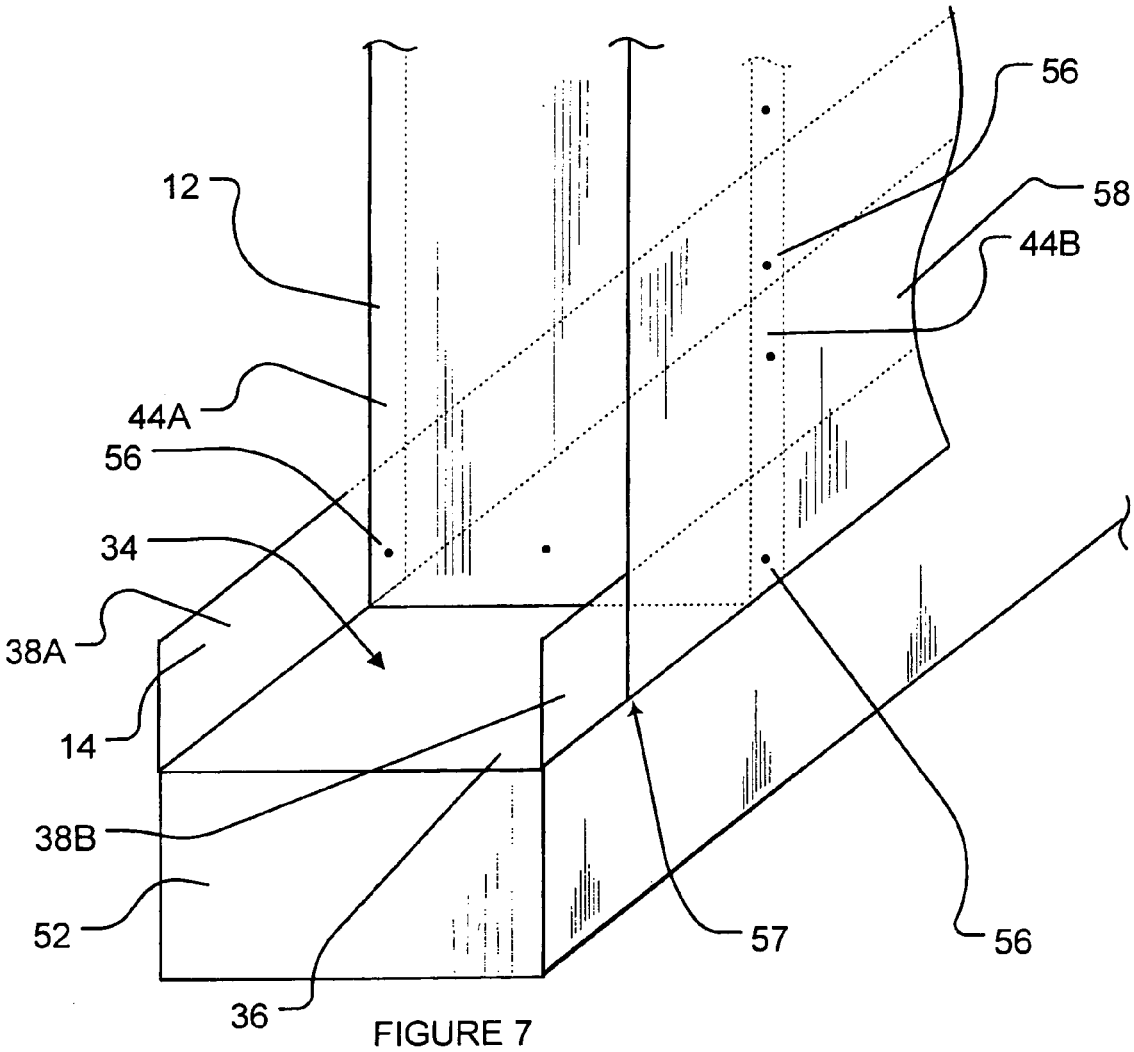
FIG. 7 is a partial isometric view depicting a stud coupled to the lower track of the FIG. 1 framing system.

FIG. 7 is a magnified view of a portion of framing system 48 (FIG. 1) which shows how the lower end of stud 12 is coupled to lower track 14 in accordance with a particular embodiment of the invention. Preferably, but not necessarily, the lower end of stud 12 extends downwardly into upwardly opening channel 34 of lower track 14, with the lowermost end of stud 12 abutting against the upper surface of web 36. In some embodiments, stud 12 may be spaced apart from web 36 to allow fire retardant material (not shown) to be inserted into channel 34.

Side members 44A, 44B of stud 12 are coupled at their lower ends to legs 38A, 38B. In the illustrated embodiment, the means for coupling side members 44A, 44B to legs 38A, 38B comprises one or more suitable fasteners 56. Fasteners 56 may comprise screws, nails, staples, rivets, spot welds, crimping fasteners or the like. Additionally or alternatively, the means for coupling side members 44A, 44B to legs 38A, 38B of lower track 14 may comprise welding, the administration of a suitable adhesive and/or any other coupling means capable of coupling side members 44A, 44B to legs 38A, 38B.

Figure 8A:
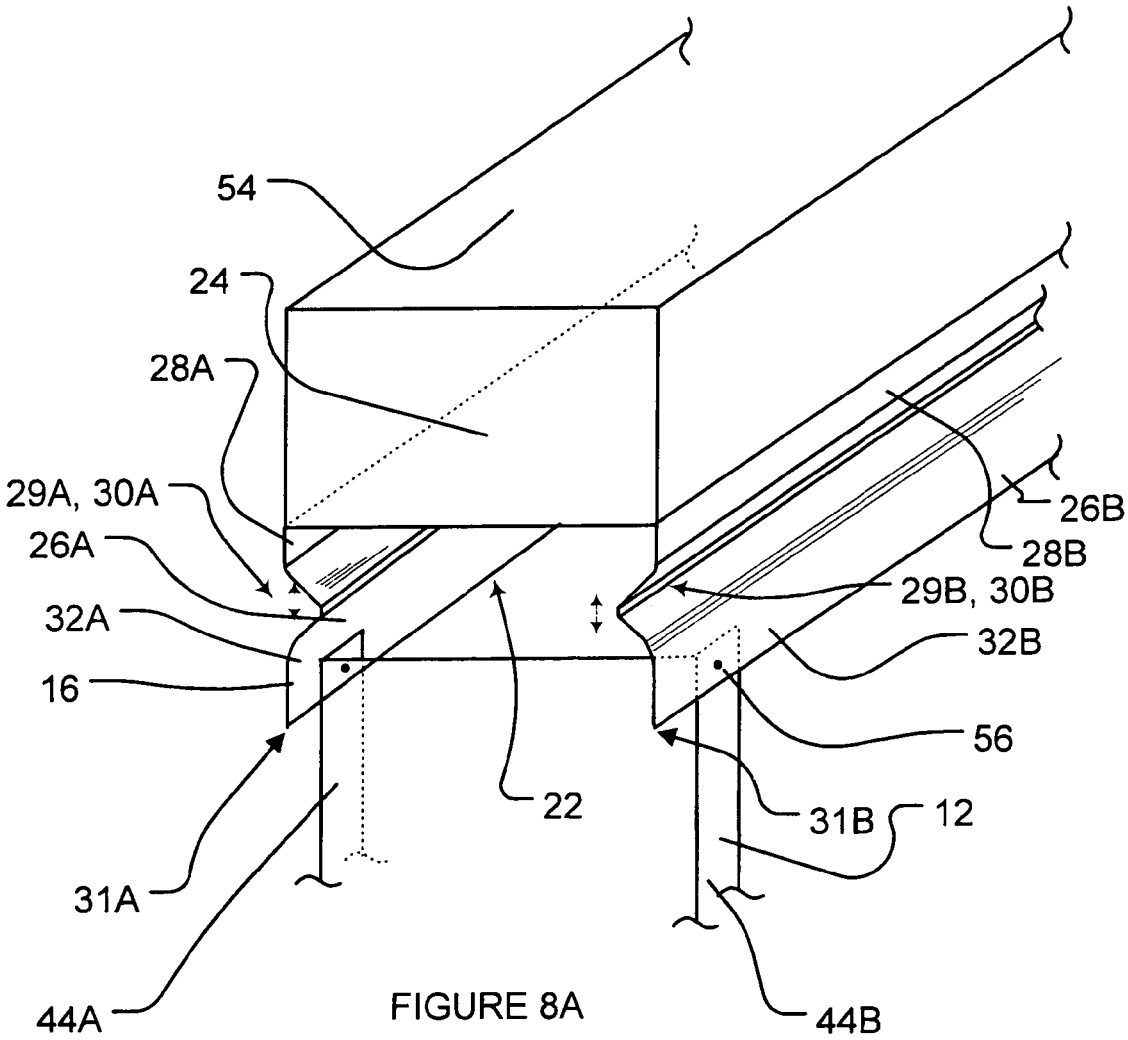
FIG. 8A is a partial isometric view depicting a stud coupled to the upper track of the FIG. 1 framing system, wherein the legs of the track are in a relatively expanded state.

FIG. 8A is a magnified view of the coupling between the upper end of stud 12 and upper track 16 in accordance with a particular embodiment of the invention. In the illustrated embodiment, the upper end of stud 12 extends upwardly into downwardly opening channel 22 of upper track 16. Preferably, the upper end of stud 12 extends only partially into channel 22 so that track 16 can accommodate relative vertical movement of building structure components 52, 54 (FIG. 1) by leaving room for corresponding vertical movement of stud 12 as discussed further below. In some embodiments, fire retardant material (not shown) may be inserted into channel 22 between stud 12 and web 24. Side members 44A, 44B of each stud 12 are coupled at their upper ends to the lower portions 32A, 32B of the legs 26A, 26B of upper track 16. In the illustrated embodiment, the means for coupling side members 44A, 44B to lower portions 32A, 32B comprises one or more suitable fasteners 56. In other embodiments, side members 44A, 44B may be additionally or alternatively coupled to lower portions 32A, 32B using any of the other coupling means mentioned above.

As shown best in FIGS. 1 and 7, wall covering 58 is mounted to the side members 44A, 44B by suitable fasteners 56. Additionally or alternatively, wall covering 58 may be mounted to side members 44A, 44B by any of the other coupling means mentioned above. Wall covering 58 may also be mounted to upper or lower tracks 16, 14. Wall covering 58 may comprise a plurality of panels or a single piece of material. Adjacent wall covering panels may be staggered relative to one another. Wall covering 58 may comprise several layers, which may include layers of wall covering material, insulation material, soundproofing material, waterproofing material, fire proofing material and the like. The space between studs 12 and behind wall covering 58 may contain other building components, such as insulation, fire proofing material, conduits for temperature control systems, electrical cabling, water conduits and the like. Wall covering 58 may be covered with tape, baseboards and/or other finishing products to conceal fasteners 56, to conceal the joints between adjacent wall covering panels and/or to conceal the joints between wall covering 58 and other floor and/or ceiling components.

Referring to wall 46 of FIG. 1, variation in the load experienced by the building structure may cause the distance between building structure components 52, 54 to vary. For example, upper building structure component 54 (or portions thereof) may deform or otherwise move closer to (or further from) lower building structure component 52. Lower building structure component 52 (or portions thereof) may also deform or otherwise move closer to (or further from) upper building structure component 54. Under such conditions, the relative movement between building structure components 52, 54 causes deformation of deformable portions 30A, 30B of legs 26A, 26B and corresponding relative vertical movement between studs 12 and building structure component 54. The deformation of legs 26A, 26B and the corresponding vertical movement of studs 12 prevents damage to the components of framing system 48 and wall 46 including wall covering 58, which is also permitted to move relative to building structure component 54.

Figure 8B:
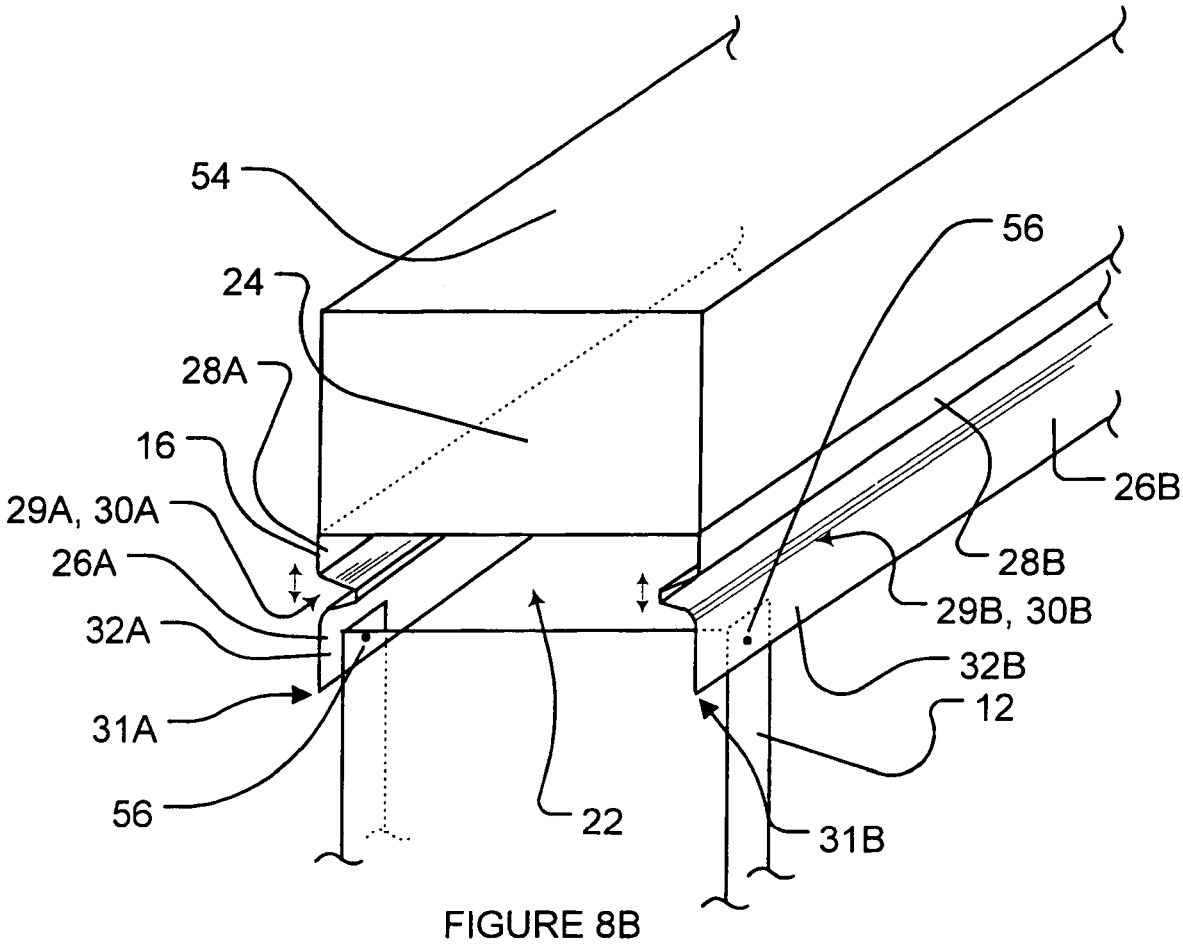
FIG. 8B is a partial isometric view depicting the stud and upper track of FIG. 8A, wherein the legs of the track are in a relatively compressed state.

As discussed above, upper tracks 16 of framing system 48 (FIG. 1) comprise legs 26A, 26B having deformable portions 30A, 30B. In the illustrated embodiment of FIG. 1, the deformable portions 30A, 30B of legs 26A, 26B comprise grooves 29A, 29B. FIG. 8A depicts upper track 16 in a first configuration wherein grooves 29A, 29B of legs 26A, 26B are moderately expanded and FIG. 8B depicts upper track 16 in a second configuration wherein grooves 29A, 29B of legs 26A, 26B are moderately compressed. FIGS. 3B and 3C respectively depict magnified views of leg 26B and groove 29B in the moderately expanded configuration of FIG. 8A and the moderately compressed configuration of FIG. 8B.

Referring to FIGS. 1, 3A-3D, 8A and 8B, the grooves 29A, 29B of legs 26A, 26B of track 16 deform to accommodate changes in the separation between building structure components 52, 54. For example, when the load on the floor above wall 46 decreases or the load on the floor below wall 46 increases, the relative distance between building structure components 52, 54 may increase. When the separation of building structure components 52, 54 increases, upper track 16 and its grooves 29A, 29B may expand to a relatively expanded state. For example, grooves 29A, 29B may expand from a state similar to that of FIGS. 3C and 8B to a relatively expanded state similar to that of FIGS. 3B and 8A. In some circumstances where the separation of building structure components 52, 54 increases further, grooves 29A, 29B may expand to a significantly expanded state similar to that of groove 29B in FIG. 3A.

When the load on the floor above wall 46 increases or the load on the floor below wall 46 decreases, the relative distance between building structure components 52, 54 may decrease. When the separation between building structure components 52, 54 decreases, upper track 16 and its grooves 29A, 29B may be compressed to a relatively compressed state. For example, grooves 29A, 29B may be compressed from a state similar to that of FIGS. 3B and 8A to a relatively compressed state similar to that shown in FIGS. 3C and 8B. In some circumstances where the separation of building structure components 52, 54 decreases further, grooves 29A, 29B may be compressed to a significantly compressed state similar to that of groove 29B of FIG. 3D.

As shown in FIGS. 1 and 7, the bottom ends of studs 12 are mounted to legs 38A, 38B of lower track 14, which in turn is mounted to lower building structure component 52. In the illustrated embodiment, legs 38A, 38B of lower track 14 do not have deformable portions and the position of studs 12 is fixed relative to lower building structure component 52. Accordingly, any change in the relative distance between building structure components 52, 54 causes relative vertical movement between studs 12 and upper building structure component 54 and between studs 12 and web 24 of upper track 16, which is mounted to building structure component 54.

The movement of studs 12 relative to upper building structure component 54 and web 24 is facilitated by compression and/or expansion of grooves 29A, 29B. As can be seen most clearly by comparing FIGS. 3A-3D, compression of grooves 29A, 29B is accompanied by a corresponding decrease in the vertical dimension 35 of grooves 29A, 29B, such that lower portions 32A, 32B and distal edges 31A, 31B of legs 26A, 26B move upwardly closer to web 24 (and closer to building structure component 54). Conversely, the expansion of grooves 29A, 29B is accompanied by a corresponding increase in the vertical dimension 35 of grooves 29A, 29B, such that lower portions 32A, 32B and distal edges 31A, 31B move downwardly further away from web 24 (and further from building structure component 54). As shown in FIGS. 8A, 8B, the upper ends of studs 12 are coupled to lower portions 32A, 32B of legs 26A, 26B. Accordingly, the movement of lower portions 32A, 32B and distal edges 31A, 31B which accompanies compression and expansion of grooves 29A, 29B facilitates the movement of studs 12 relative to upper building structure component 54 and web 24.

Typically, engineering specifications and/or building codes or the like will specify an amount of vertical movement which must be accommodated by a building's framing system 48 (FIG. 1). Such specifications and codes may be particular to a given building, to a given class of buildings, to a given geographical region or the like. The amount of deformation facilitated by grooves 29A, 29B of legs 26A, 26B and the corresponding amount of movement of studs 12 relative to web 24 (and relative to building structure component 54) may be designed to meet such specifications and/or codes.

Figure 9:
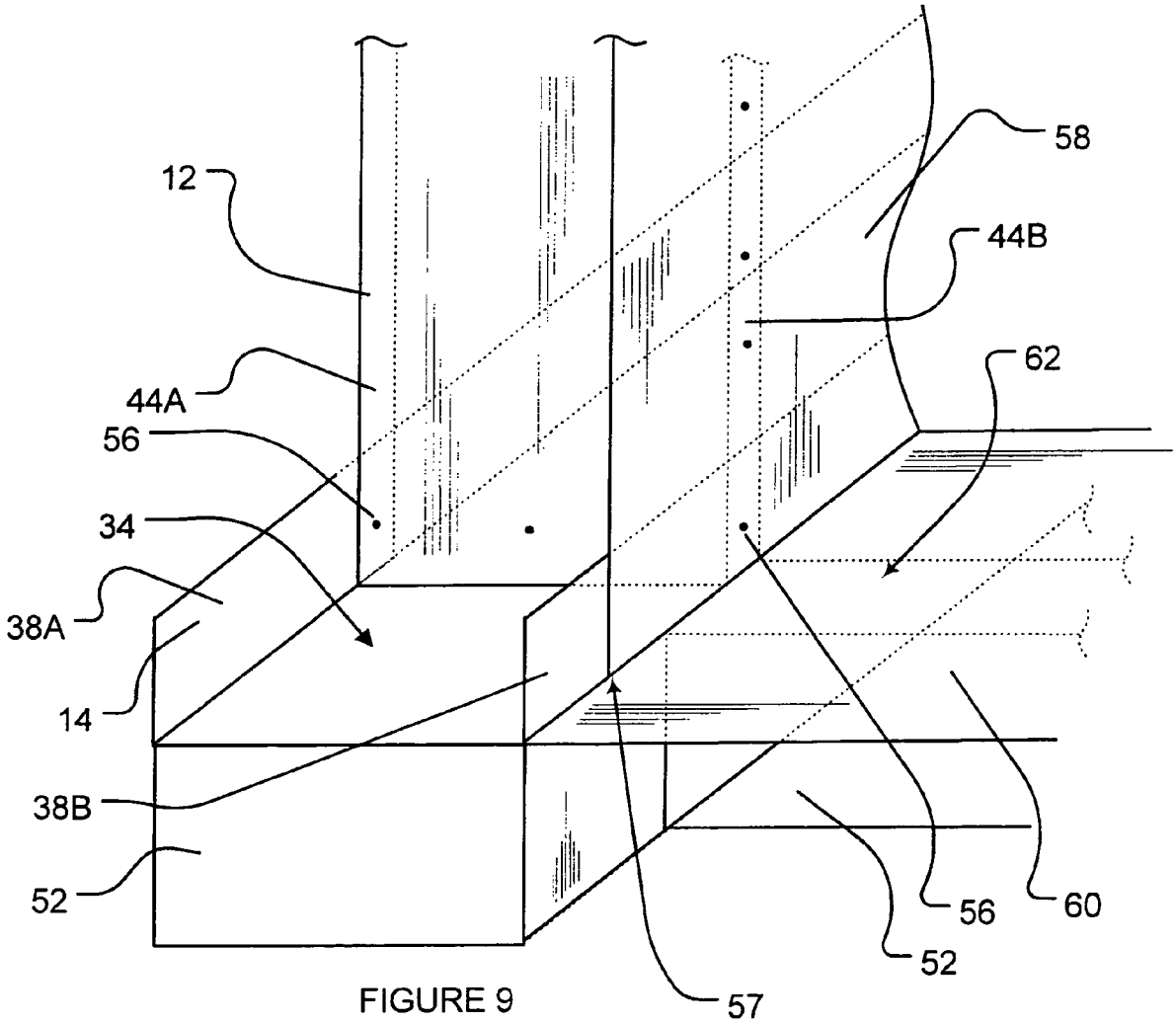
FIG. 9 is a partial isometric view of a particular floor construction which may be used in conjunction with the FIG. 1 framing system.

FIG. 9 shows a magnified view of a particular floor construction 62 which may be used together with the framing system 48 of FIG. 1. The building with floor construction 62 comprises a number of horizontal building structure components 52. In the illustrated embodiment, horizontal building structure components 52 comprise a framework of orthogonal members. One or more of the horizontal building structure components 52 support lower track 14. Horizontal building structure components 52 also support a floor covering 60. Floor covering 60 may be mounted to horizontal building structure components 52 by any suitable fastener(s) or other coupling means (not shown).

A wall covering 58 may be coupled to stud(s) 12 by fasteners 56 or other coupling means as described above. In the illustrated embodiment, the lowermost edge 57 of wall covering 58 extends to approximately the level of floor covering 60, to form an abutment joint between wall covering 58 and floor covering 60. Those skilled in the art will appreciate that there may be play (i.e. space) in the abutment joint between wall covering 58 and floor covering 60. Although not shown in FIG. 9, the joint between wall covering 58 and floor covering 60 may comprise baseboards, tape or other finishing implements which cover the abutment joints to conceal any imperfections therein.

The bottom ends of studs 12 are mounted to legs 38A, 38B of lower track 14, which in turn is mounted to lower building structure components 52. In the illustrated embodiment, legs 38A, 38B of lower track 14 do not have deformable portions and the position of studs 12 is fixed relative to lower building structure components 52. Because wall covering 58 is mounted to studs 12, floor covering 60 is mounted to building structure components 52 and studs 12 are fixed relative to building structure components 52, there is very little relative movement between floor covering 60 and wall covering 58. In alternative embodiments, wall covering 58 may move upwardly or downwardly relative to floor covering 60 when there is relative movement between upper and lower building structure components 52, 54.

Figure 10:
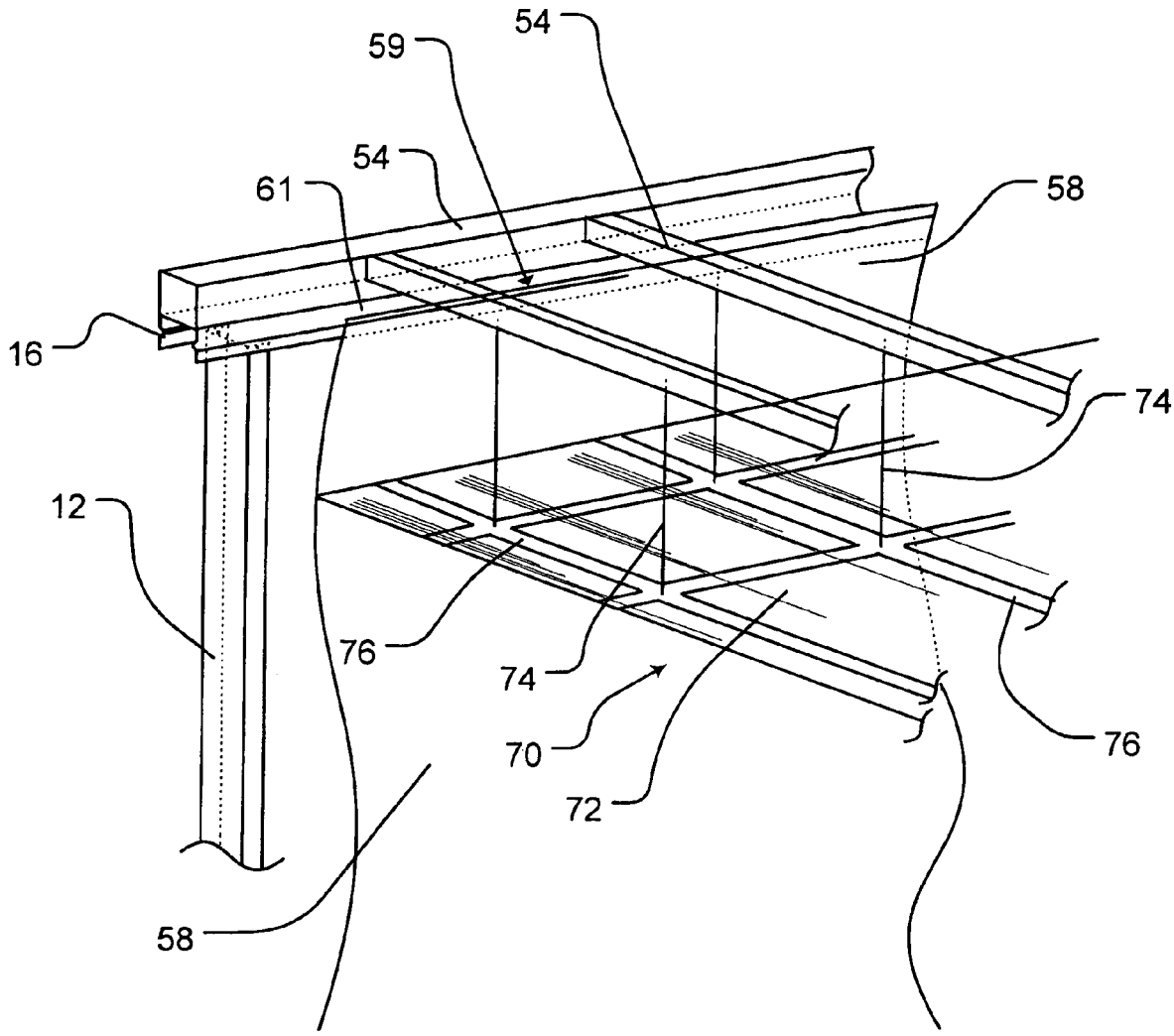
FIG. 10 is a partial isometric view of a particular ceiling construction which may be used in conjunction with the FIG. 1 framing system.

FIG. 10 shows a magnified view of a particular ceiling construction 70 which may be used together with the framing system 48 of FIG. 1. In the illustrated embodiment, horizontal building structure components 54 comprise a framework of orthogonal members. One or more of the horizontal building structure components 54 support deformable upper track 16 as described above. Horizontal building structure components 54 also support a ceiling covering 72. In the illustrated embodiment, ceiling covering 72 is supported by vertical cables 74 which are attached at their opposing ends to horizontal members 54 and to horizontal brace members 76.

Wall covering 58 may be mounted to stud(s) 12 by fasteners 56 as described above. The uppermost end 59 of wall covering 58 preferably extends upwardly past ceiling covering 72, such that ceiling covering 72 extends transversely to abut substantially orthogonally against wall covering 58. Those skilled in the art will appreciate that there may be play (i.e. space) in the abutment joints between wall covering 58 and ceiling covering 72. Although not shown in FIG. 10, the joints between wall covering 58 and ceiling covering 72 may include tape or other finishing implements to help conceal any imperfections in the wall/ceiling joints.

When relative movement occurs between studs 12 and building structure component 54 in accordance with the invention, wall covering 58 may move upwardly or downwardly relative to ceiling covering 72. Preferably, a gap 61 is provided between the uppermost edge 59 of wall covering 58 and building structure components 54 such that wall covering 58 may move upwardly relative to building structure component 54 without impacting building structure components 54.

The above description focuses on particular embodiments of how the interior wall, floor and ceiling structures of a building can be connected to and operate in conjunction with framing system 48 of the present invention. Those skilled in the art will appreciate that there are many possible techniques for building a wall, floor or ceiling which incorporate a framing system 48 in accordance with the invention. Those skilled in the art will also appreciate that the exterior structure of a wall may be constructed to operate in a manner that is similar to that of the interior wall structure.

As will be apparent to those skilled in the art in the light of the foregoing disclosure, many alterations and modifications are possible in the practice of this invention without departing from the spirit or scope thereof. For example:

In the embodiment of FIGS. 1-3 and 5-10, upper track 16 is described as having deformable legs 26A, 26B and lower track 14 is described as having legs 38A, 38B which are not designed for deformation. In alternative embodiments, lower track 14 may have deformable legs and upper track 16 may have legs which are not designed for deformation. In further alternative embodiments, both upper track 16 and lower track 14 may have deformable legs. In general, the invention should be understood to incorporate tracks having one or more legs which facilitate vertical deformation whether the deformation takes place on upper tracks, lower tracks or both upper and lower tracks and the invention should be understood to include framing systems incorporating any such tracks.

In the embodiments described above, the tracks have been depicted as consisting essentially of a unitary piece of material. This is not generally necessary, as part of the track may be fabricated separately and then coupled to one another. For example, the legs may consist essentially of a unitary piece of material and the legs may be mounted to a separate web member. A section of the legs that includes the deformable portion may consist essentially of a unitary piece of material and may be coupled to other parts of the leg or to a separate web member.

Studs 12 depicted and described above are generally channel-shaped. Studs 12 may have other shapes. For example, side members 44A, 44B may only extend along a portion of the length of stud 12 where stud 12 is required to attach to tracks 14, 16 and/or to wall covering 58. In other regions, stud 12 may comprise only web portion 42 without side members 44A, 44B. In some alternative embodiments, flanges 47A, 47B may not be required. In other alternative embodiments, flanges 47A, 47B may be replaced with a second web, parallel to web 42, which joins side members 44A, 44B such that stud 12 has a hollow, substantially rectangular cross-section. In further alternative embodiments, stud 12 may be solid with a substantially rectangular cross-section. The invention should be understood to incorporate any type of stud which is mountable to tracks 14, 16 and which may support wall covering 58 as described above.

In the illustrated embodiment of FIGS. 1-3 and 5-10, studs 12 are coupled to the inside of legs 26A, 26B of upper track 16. This coupling is shown best in FIGS. 8A, 8B where the upper ends of studs 12 extend into the inside of channel 22. Similarly, studs 12 are coupled to the inside of legs 38A, 38B of lower track 14. This coupling is shown best in FIG. 7, where the lower ends of studs 12 extend into the inside of channel 34. The coupling of the upper ends of studs 12 to the inside of channel 22 and the lower ends of studs 12 to the inside of channel 34 is advantageous because it allows stud 12 to be fabricated at any length and then cut to a desired length for use in the framing system. In alternative embodiments, studs 12 may be prefabricated to a particular length and the upper and lower ends of studs 12 may comprise particular implements for mounting studs 12 to tracks 14, 16. For example, the upper ends of a stud may be wider than upper track 16 and may comprise a pair of slots for receiving legs 26A, 26B of upper track 16. In such embodiments, the upper end of the stud may be fastened to the outside of legs 26A, 26B or to the outside and inside of legs 26A, 26B. In other alternative embodiments, the upper ends of a stud may comprise flanges for coupling the stud to the outsides of legs 26A, 26B. In such embodiments, the stud may not extend into channel 22. The studs may comprise similar alternative mounting implements at their lower ends. Those skilled in the art will appreciate that the invention is independent of the particular means used to couple studs 12 to lower and upper tracks 14, 16 and that the invention should be understood to include any coupling means capable of functioning as described herein.

Figure 11:
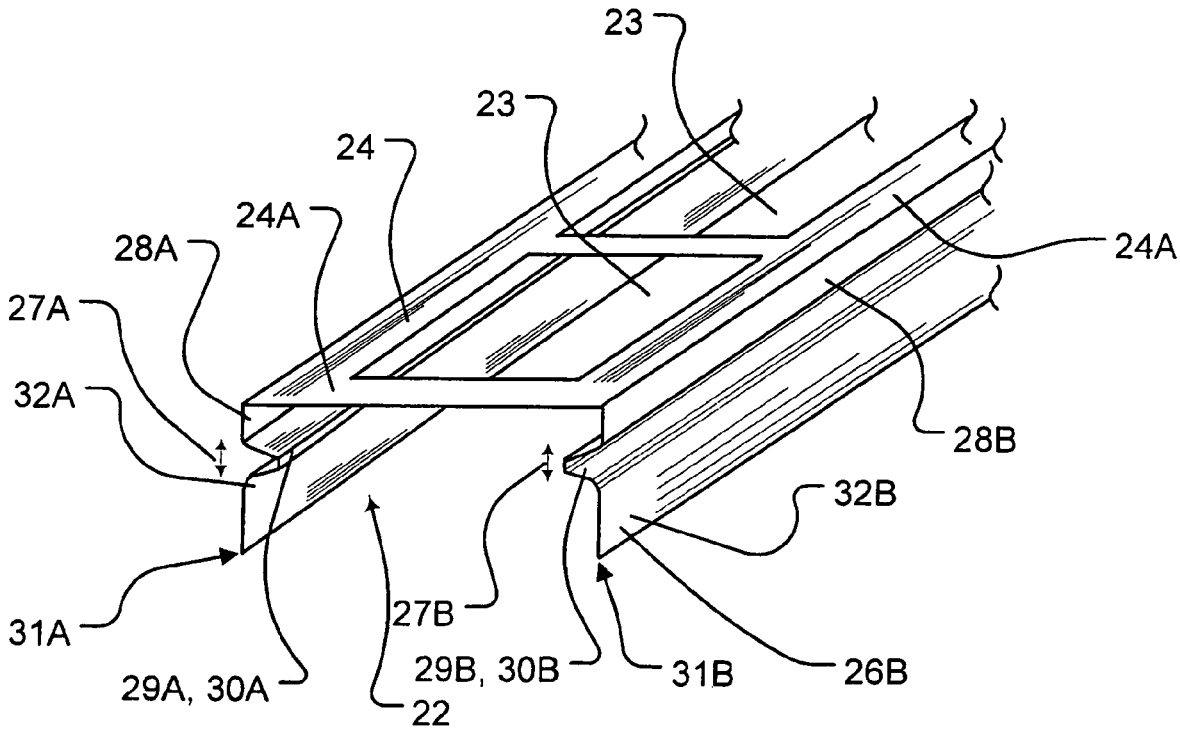
FIG. 11 is partial isometric view of a track according to an alternative embodiment of the invention.

FIG. 11 shows track 16 in accordance with an alternative embodiment of the invention, wherein web 24 comprises frame members 24A which define a number of apertures 23 in the surface of web 24. Web 36 of lower track member 14 (FIG. 5), web 124 of track 116 (FIG. 4A-4D), web 42 of stud 12 (FIG. 6) and all of the webs of the other track embodiments disclosed herein may have a similar structure to that shown in FIG. 11. In general, as used in this description, the term "web" need not entail a continuous and solid piece of material and a "web" may be apertured as shown in FIG. 11.

Figure 12:
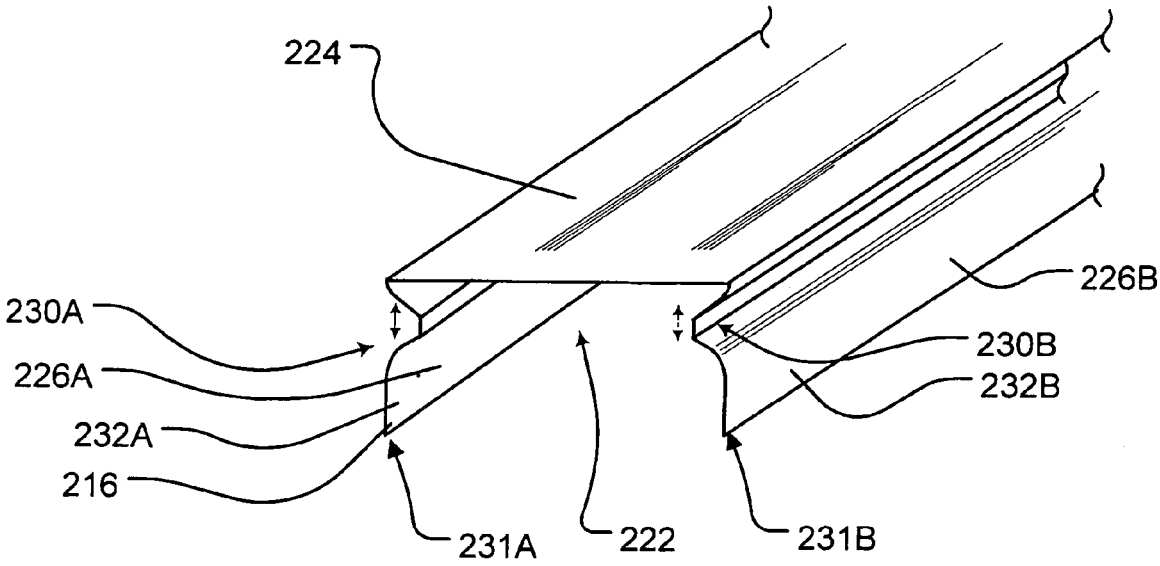
FIG. 12 is an isometric view of a track in accordance with another alternative embodiment of the invention.

FIG. 12 depicts an upper track 216 in accordance with an alternative embodiment of the invention. In FIG. 12, features of track 216 are assigned reference numbers that have a leading "2" relative to similar features of track 16 (FIG. 2). Track 216 is similar to track 16 of FIG. 2, except that legs 226A, 226B of track 216 do not contain upper portions 28A, 28B and the deformable portions 230A, 230B of track 216 extend directly from horizontally-extending web 224. In the FIG. 12 embodiment, deformable portions 230A, 230B of track 216 comprise grooves which are shaped and which function in a manner similar to grooves 29A, 29B of track 16 (see FIGS. 3A-3D and 8A-8B). In further alternative embodiments, deformable portions 230A, 230B may comprise any of the alternative types of deformable portions described herein. Other aspects of track 216 are substantially similar to track 16 described above.

Figure 13A:
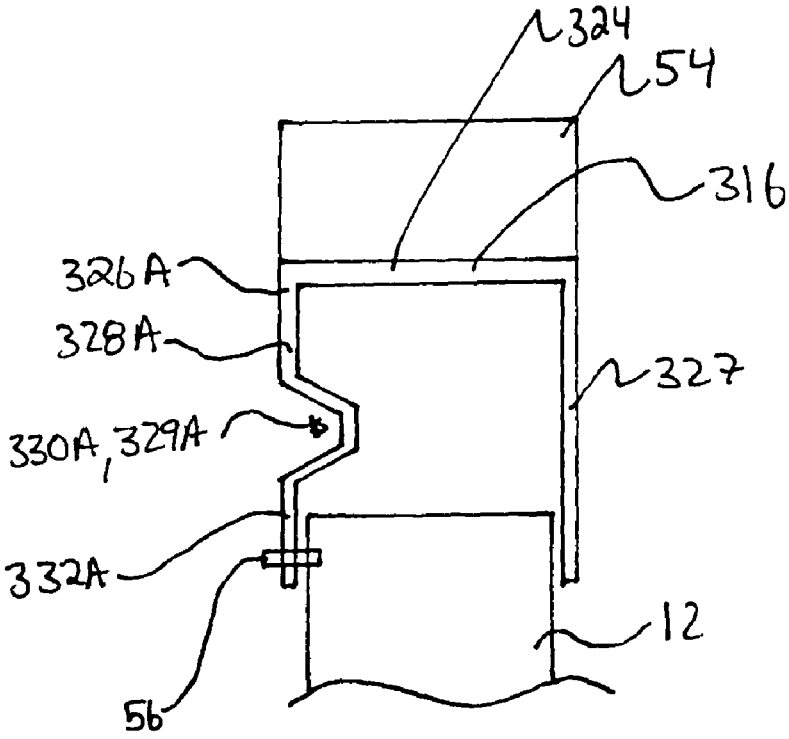
FIGS. 13A-13B are schematic cross-sectional views which depict tracks in accordance with still further alternative embodiments of the invention.
Figure 13B:
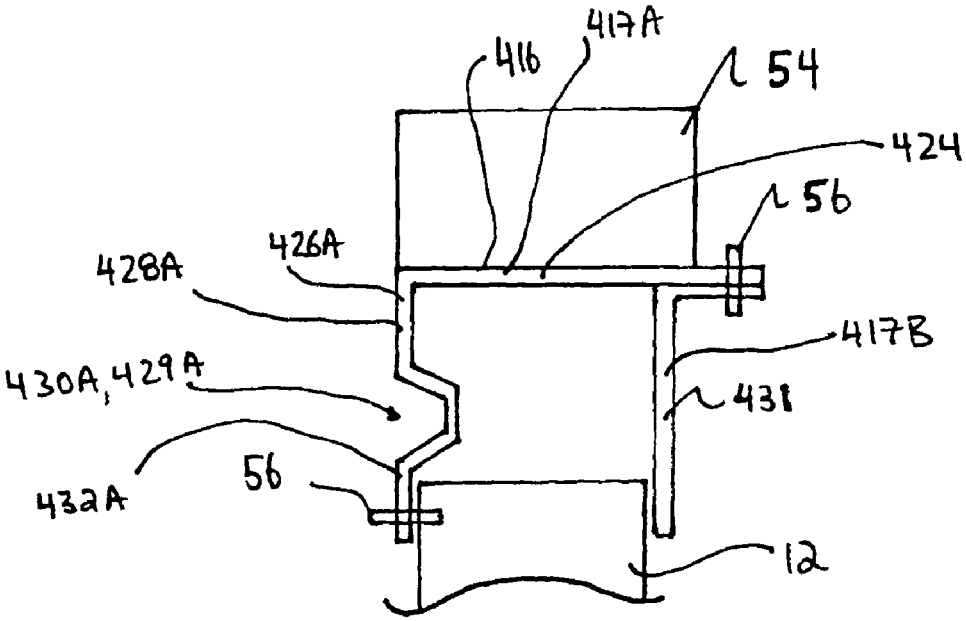

FIGS. 13A and 13B respectively depict cross-sectional views of tracks 316 and 416 according to alternative embodiments of the invention wherein only one leg comprises a deformable portion.

FIG. 13A depicts a track 316 having one leg 326A which comprises an upper portion 328A, a deformable portion 330A and a lower portion 332A and a second leg 327 which is not designed to be deformable. Lower portion 332A of leg 326A is fastened to stud 12 with a suitable fastener 56 or other coupling means and web 324 of track 316 is similarly fastened to building structure component 54. In the illustrated embodiment, deformable portion 330A comprises a groove 329A similar to groove 29A of FIGS. 8A, 8B. In operation, relative movement between building structure components causes expansion or contraction of groove 329A and corresponding movement of stud 12 relative to building structure component 54 and web 324. Leg 327 may serve as a guide for the movement of stud 12 relative to building structure component 54 and web 324. Those skilled in the art will appreciate that leg 326A and deformable portion 330A of track 316 may be replaced with any of the alternative leg designs and any of the alternative deformable portions described above.

FIG. 13B depicts a track 416 formed from two components 417A, 417B which are coupled by suitable fasteners 56 or other coupling means. Component 417A comprises horizontally-extending web 424 and leg 426A. Leg 426A comprises an upper portion 428A, a deformable portion 430A and a lower portion 432A. Component 417B is generally angularly shaped with a leg portion 431 that is not designed to be deformable. Lower portion 432A of leg 426A is fastened to stud 12 with a suitable fastener 56 or other coupling means and web 424 of component 417A is similarly fastened to building structure component 54. In the illustrated embodiment, deformable portion 430A comprises a groove 429A similar to groove 29A of FIGS. 8A, 8B. In operation, relative movement between building structure components causes expansion or contraction of groove 429A and corresponding movement of stud 12 relative to building structure component 54 and web 424. Leg 431 may serve as a guide for the movement of stud 12 relative to building structure component 54 and web 424. Those skilled in the art will appreciate that leg 426A and deformable portion 430A of track 416 may be replaced with any of the alternative leg designs and any of the alternative deformable portions described above.

FIGS. 14A-14D are schematic, cross-sectional depictions of a number of alternative embodiments of track 16 with different types of deformable portions 30A, 30B.

Figure 14A:
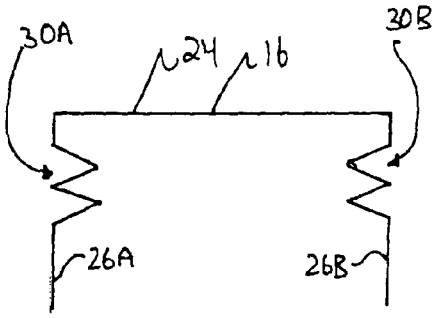
FIGS. 14A-14F are schematic cross-sectional views which depict tracks in accordance with further alternative embodiments of the invention.

FIG. 14A shows an alternative embodiment, where the deformable portions 30A, 30B of track 16 comprise multiple grooves in legs 26A, 26B.

Figure 14B:
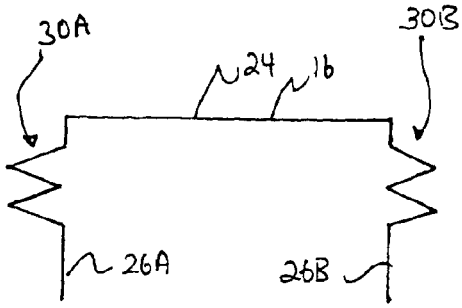
Figure 14C:
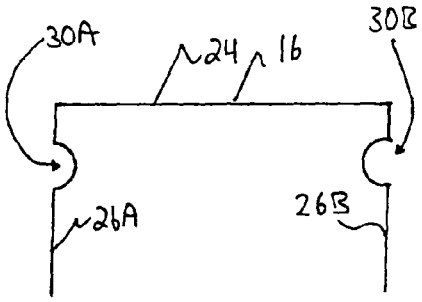

FIG. 14B shows an alternative embodiment where the deformable portions 30A, 30B comprise grooves which open into channel 22 and project towards the outside of channel 22.

Deformable portions 30A, 30B may also comprise grooves having different shapes. FIG. 14 C depicts a particular embodiment of deformable portions 30A, 30B wherein the grooves are arcuate in cross-section. In general, a deformable portion 30A, 30B may comprise one or more edge portions that are arcuate in cross-section. Those skilled in the art will appreciate that grooves having other shapes are also possible to provide the functionality described herein.

Figure 14D:
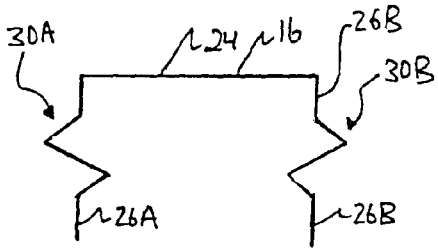

FIG. 14D depicts another alternative embodiment, where deformable portions 30A, 30B comprises grooves which project into channel 22 and grooves which project away from channel 22. It will be appreciated that in addition to the embodiments shown in FIGS. 14A-14D, deformable portions 30A, 30B may generally comprise any number of grooves which project into channel 22, away from channel 22 or any combination of into and away from channel 22 and such grooves may have any of the cross-sections described above.

In the track embodiments depicted and described above, the deformable portions of the track legs preferably comprise at least one bend which extends in the longitudinal direction of the track and which is compressible to reduce its interior angle and/or expandable to increase its interior angle. In preferred embodiments, track legs, including the deformable portions, are formed from a unitary piece of material. The deformable portions of the track legs depicted and described above may comprise grooves, which may compress and/or expand as described above to provide vertical deformation of the legs. In general, the track legs may comprise other types of deformable portions.

Figure 14E:
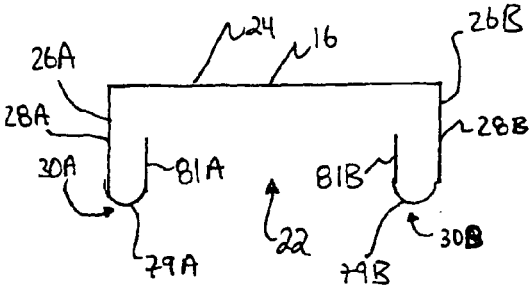

FIG. 14E shows another alternative embodiment, where legs 26A, 26B are bent at bends 79A, 79B to provide generally vertically oriented surfaces 81A, 81B which extend into channel 22. Studs (not shown) may be coupled to surfaces 81A, 81B by any of the coupling means described above. Legs 26A, 26B may deform (i.e. at bends 79A, 79B) to provide relative movement of the studs towards or away from web 24. The portion oft legs 26A, 26B which forms bends 79A, 79B may change in response to relative movement of the building structure, such that the vertical dimension of upper portions 28A, 28B decreases or increases and the length of surfaces 81A, 81B correspondingly increases or decreases to provide relative movement of the studs toward or away from web 24. In other embodiments (not shown), bends 79A, 79B may bend outwardly such that surfaces 81A, 81B are outside channel 22.

Figure 14F:
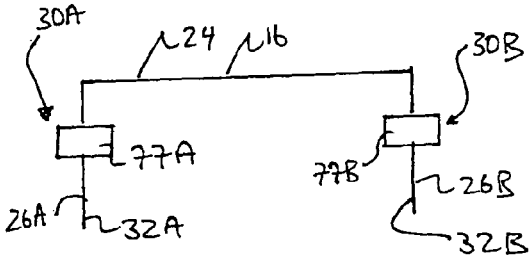

FIG. 14F shows another alternative embodiment, where the deformable portions 30A, 30B of legs 26A, 26B comprise elastic deformable members 77A, 77B. Elastic deformable members 77A, 77B may be fabricated separately from track 16 (i.e. elastic deformable members 77A, 77B may be non-integral with track 16) and later coupled to track 16 during subsequent assembly thereof. For example, elastic members 77A, 77B may comprise compressible springs, spring assemblies, rubber or other elastomeric spacers or the like which are coupled to legs 26A, 26B in a manner that provides for deformation of legs 26A, 26B. Elastic deformable members 77A, 77B may be located and/or connected in between horizontal web 24 and lower leg members 32A, 32B.

Accordingly, the scope of the invention is to be construed in accordance with the substance defined by the following claims.

What is claimed is:

1. A track for use in a building framing system, the track comprising:

a web that extends in a longitudinal direction; and one or more legs which extend from the web and which extend along at least a portion of the web in the longitudinal direction, each leg comprising a deformable portion located between the web and a distal edge of the leg;

wherein each deformable portion is bent along four or more longitudinally-extending bend lines to form four or more corresponding bends and each of the bends is at least one of: compressible to reduce its interior angle and expandable to increase its interior angle; and wherein deformation of the deformable portion of each leg is accompanied by relative movement of the distal edge of the leg in a direction that is at least one of: toward the web and away from the web.

2. A track according to claim 1 wherein a section of each leg that includes the deformable portion consists essentially of a unitary piece of material.

3. A track according to claim 2 wherein, for the deformable portion of each leg, the four or more longitudinally-extending bend lines and the four or more corresponding bends extend longitudinally to be substantially longitudinally coextensive with their corresponding leg to provide at least one deformable groove that extends in the longitudinal direction to be substantially longitudinally coextensive with its corresponding leg, the deformable groove being at least one of: compressible in a direction orthogonal to the longitudinal direction and expandable in a direction orthogonal to the longitudinal direction.

4. A track according to claim 3 wherein each deformable groove comprises: a first angled groove portion that extends from a first one of the bends in an upper portion of the leg, a second angled groove portion that extends from a second one of the bends in a lower portion of the leg and a central groove portion that extends between third and fourth ones of the bends in the first and second angled groove portions.

5. A track according to claim 4 wherein, prior to deformation, an angle between the first angled groove portion and the upper portion of the leg, an angle between the second angled groove portion and the lower portion of the leg, an angle between the first angled groove portion and the central groove portion and an angle between the second angled groove portion and the central groove portion are all in a range between 105° and 165°.

6. A track according to claim 5 wherein each deformable groove is compressible to a relatively compressed state and wherein, in the relatively compressed state, an angle between the first angled groove portion and the upper portion of the leg, an angle between the second angled groove portion and the lower portion of the leg, an angle between the first angled groove portion and the central groove portion and an angle between the second angled groove portion and the central groove portion are all in a range between 60° and 150°.

7. A track according to claim 5 wherein each deformable groove is expandable to a relatively expanded state and wherein, in the relatively expanded state, an angle between the first angled groove portion and the upper portion of the leg, an angle between the second angled groove portion and the lower portion of the leg, an angle between the first angled groove portion and the central groove portion and an angle between the second angled groove portion and the central groove portion are all in a range between 120° and 180°.

8. A track according to claim 3 wherein each deformable groove is resiliently deformable.

9. A track according to claim 3 wherein each leg comprises a flat portion between its at least one deformable groove and its distal edge, the flat portion providing a surface for coupling one or more studs to the track.

10. A track according to claim 3 wherein the one or more legs comprise a pair of spaced apart legs which extend from the web to define a channel therebetween.

11. A track according to claim 10 wherein each deformable groove opens into the channel.

12. A track according to claim 10 wherein each deformable groove opens outwardly from the channel.

13. A track according to claim 3 wherein each deformable groove comprises at least one portion that is curved in cross-section.

14. A track according to claim 2 wherein the one or more legs comprise a pair of spaced apart legs which extend from the web to define a channel therebetween and wherein the deformable portion of each leg comprises a curved bend of the leg, the curved bend having an interior angle greater than 90° and curving toward an interior of the channel.

15. A track according to claim 3 used in a wall of a building, the wall comprising an opposing track and one or more studs, each stud extending between and coupled at its opposite ends to the track and to the opposing track.

16. A track according to claim 15 wherein a first portion of each stud is coupled to the one or more legs of the track between the deformable portions and the distal edges of the one or more legs, such that relative movement of the stud toward the web causes compression of the four or more bends of the deformable portion of each leg.

17. A track according to claim 15 wherein a first portion of each stud is coupled to the one or more legs of the track between the deformable portions and the distal edges of the one or more legs, such that relative movement of the stud away from the web causes expansion of the four or more bends of the deformable portion of each leg.

18. A track according to claim 16 wherein the one or more legs of the track comprise a pair of spaced apart legs which extend from the web to define a channel therebetween.

19. A track according to claim 18 wherein each leg of the track comprises a flat portion located between its deformable portion and its distal edge and wherein a first end portion of each stud extends into the channel and is coupled to the flat portion of each leg.

20. A track according to claim 18 wherein the channel is a downwardly opening channel.

21. A track according to claim 18 wherein the channel is an upwardly opening channel.

22. A track according to claim 15 wherein an opposing end portion of each stud is coupled to the opposing track in a manner that does not permit substantial relative movement between the stud and the opposing track.

23. A track according to claim 15 wherein the opposing track is substantially similar to the track and an opposing end of each stud is coupled to the opposing track in a manner that permits relative movement between the stud and a web of the opposing track.

24. A track according to claim 1 wherein the deformable portion of each leg comprises an elastic member.

25. A track according to claim 24 wherein each elastic member is fabricated separately from the track and subsequently coupled to the corresponding leg of the track.

26. A track according to claim 24 wherein the elastic member associated with each leg comprises at least one deformable groove that extends in the longitudinal direction, the deformable groove being at least one of: compressible in a direction orthogonal to the longitudinal direction and expandable in a direction orthogonal to the longitudinal direction.

27. A track according to claim 26 wherein each deformable groove is resiliently deformable.

28. A track according to claim 26 wherein the one or more legs comprise a pair of spaced apart legs which extend from the web to define a channel therebetween.

29. A track according to claim 26 wherein each deformable groove opens in a direction that is one of: into the channel and outwardly from the channel.

30. A track according to claim 26 wherein each deformable groove comprises at least one portion that is curved in cross-section.

31. A track according to claim 26 wherein the elastic member associated with each leg comprises a plurality of deformable grooves, each deformable groove extending in the longitudinal direction and each deformable groove being at least one of: compressible in a direction orthogonal to the longitudinal direction and expandable in a direction orthogonal to the longitudinal direction.

32. A track according to claim 26 wherein a section of each deformable leg that includes the deformable portion consists essentially of a unitary piece of material.

33. A track according to claim 1 wherein, prior to deformation, interior angles of the four or more bends are in a range of 105° to 165°.

34. A track according to claim 1 wherein each of the four or more bends is compressible to a relatively compressed state and wherein, in the relatively compressed state, interior angles of the four or more bends are in a range of 60° to 150°.

35. A track according to claim 1 wherein each of the four or more bends is expandable to a relatively expanded state and wherein, in the relatively expanded state, interior angles of the four or more bends are in range of 120° to 180°.

36. A track according to claim 4 wherein, prior to deformation, a sum of:

(a) an angle between the first angled groove portion and the upper portion of the leg;

(b) an angle between the second angled groove portion and the lower portion of the leg;

(c) an angle between the first angled groove portion and the central groove portion; and (d) an angle between the second angled groove portion and the central groove portion;

is in a range of 420° to 660°.

37. A track according to claim 4 wherein each deformable groove is compressible to a relatively compressed state and wherein, in the relatively compressed state, a sum of:

(a) an angle between the first angled groove portion and the upper portion of the leg;

(b) an angle between the second angled groove portion and the lower portion of the leg;

(c) an angle between the first angled groove portion and the central groove portion; and (d) an angle between the second angled groove portion and the central groove portion;

is in a range of 240° to 600°.

38. A track according to claim 4 wherein each deformable groove is expandable to a relatively expanded state and wherein, in the relatively expanded state, a sum of:

(a) an angle between the first angled groove portion and the upper portion of the leg;

(b) an angle between the second angled groove portion and the lower portion of the leg;

(c) an angle between the first angled groove portion and the central groove portion; and (d) an angle between the second angled groove portion and the central groove portion;

is in a range of 480° to 720°.

39. A track according to claim 1 wherein, for each deformable portion, the four or more bends comprise:

a proximate bend at one extremity of the deformable portion at a location along the leg between the deformable portion and the web;

a distal bend at an opposing extremity of the deformable portion at a location along the leg between the deformable portion and the distal edge of the leg;

a pair of intermediate bends located along the leg between the proximate and distal bends and within the extremities of the deformable portion; and wherein the deformable portion is deformable between:

a relatively expanded configuration wherein the proximate bend and the distal bend are further apart from one another than the intermediate bends are from one another; and a relatively compressed configuration wherein the proximate bend and the distal bend are closer to one another than the intermediate bends are to one another.

40. A track according to claim 3 wherein the groove is expandable to a relatively expanded configuration wherein an opening of the groove is wider in the direction orthogonal to the longitudinal direction than an interior of the groove and compressible to a relatively compressed configuration wherein the opening of the groove is narrower in the direction orthogonal to the longitudinal direction than the interior of the groove.

41. A track according to claim 1 wherein each bend line in the deformable portion is resiliently deformable.

42. A framing system for a building wall, the framing system comprising:

a lower track comprising:

a lower web that extends in a longitudinal direction; and one or more lower legs which extend upwardly from the lower web and which extend along at least a portion of the lower web in the longitudinal direction, each lower leg comprising a lower deformable portion located between the lower web and an uppermost edge of the lower leg, wherein each lower deformable portion is bent along four or more longitudinally-extending lower bend lines to form four or more corresponding lower bends and each of the lower bends is at least one of: compressible to reduce its interior angle and expandable to increase its interior angle;

an upper track comprising:

an upper web that extends in the longitudinal direction; and one or more upper legs which extend downwardly from the upper web and which extend along at least a portion of the upper web in the longitudinal direction, each upper leg comprising an upper deformable portion located between the upper web and a lowermost edge of the upper leg, wherein each upper deformable portion is bent along four more longitudinally-extending upper bend lines to form four or more corresponding upper bends and each of the upper bends is at least one of: compressible to reduce its interior angle and expandable to increase its interior angle; and a plurality of studs which extend between the upper and lower tracks at longitudinally spaced apart locations, wherein each stud is fastened to at least one of the one or more upper legs above its lowermost edge and below its upper deformable portion and wherein each stud is fastened to at least one of the one or more lower legs below its uppermost edge and above its lower deformable portion;

wherein deformation of the lower deformable portion of each lower leg is accompanied by relative movement of at least one stud in a direction that is at least one of: toward the lower web and away from the lower web; and wherein deformation of the upper deformable portion of each upper leg is accompanied by relative movement of at least one stud in a direction that is at least one of: toward the upper web and away from the upper web.

* * * * *